US009643247B2

(12) United States Patent
Cooper et al.

(10) Patent No.: US 9,643,247 B2
(45) **Date of Patent: *May 9, 2017**

(54) MOLTEN METAL TRANSFER AND DEGASSING SYSTEM

(71) Applicant: Molten Metal Equipment innovations, LLC, Middlefield, OH (US)

(72) Inventors: Paul V. Cooper, Chesterland, OH (US); Vincent D. Fontana, Chagrin Falls, OH (US)

(73) Assignee: Molten Metal Equipment Innovations, LLC, Middlefield, OH (US)

( * ) Notice: Subject to any disclaimer, the term of this patent is extended or adjusted under 35 U.S.C. 154(b) by 451 days.

This patent is subject to a terminal disclaimer.

(21) Appl. No.: 13/841,594

(22) Filed: Mar. 15, 2013

(65) Prior Publication Data

US 2013/0306687 A1 Nov. 21, 2013

Related U.S. Application Data

(60) Continuation-in-part of application No. 13/801,907, filed on Mar. 13, 2013, and a continuation-in-part of (Continued)

(51) Int. Cl.
*B22D 37/00* (2006.01)
*B22D 7/00* (2006.01)

(Continued)

(52) U.S. Cl.
CPC ..... *B22D 37/00* (2013.01); *B22D 7/00* (2013.01); *B22D 39/00* (2013.01); *B22D 41/00* (2013.01);

(Continued)

(58) Field of Classification Search
CPC ..... B22D 7/00; B22D 39/00; B22D 41/00; B22D 37/00; C22B 21/0084; C22B 21/064; F27D 3/14; F27D 27/005

(Continued)

(56) References Cited

U.S. PATENT DOCUMENTS 35,604 A 6/1862 Guild
116,797 A 7/1871 Barnhart (Continued)

FOREIGN PATENT DOCUMENTS

CA 683469 3/1964
CA 2115929 8/1992

(Continued)

OTHER PUBLICATIONS

US 5,961,265, Oct. 5, 1999, Meneice et al. (Withdrawn).

(Continued)

*Primary Examiner* — Scott Kastler
*Assistant Examiner* — Michael Aboagye
(74) *Attorney, Agent, or Firm* — Snell & Wilmer L.L.P.

(57) ABSTRACT

Disclosed, among other things, is a transfer chamber constructed inside of or next to a vessel used to retain and degas molten metal. The transfer chamber is in fluid communication with the vessel so molten metal from the vessel is pulled through the vessel by the pump as it is degassed. This helps maintain a generally constant flow of molten metal through the degassing vessel. Other aspects relate to a system and method for efficiently performing maintenance on components positioned in a vessel.

41 Claims, 22 Drawing Sheets

Related U.S. Application Data application No. 13/802,040, filed on Mar. 13, 2013, and a continuation-in-part of application No. 13/802,203, filed on Mar. 13, 2013, and a continuation-in-part of application No. 13/725,383, filed on Dec. 21, 2012, which is a division of application No. 11/766,617, filed on Jun. 21, 2007, now Pat. No. 8,337,746.

(51) Int. Cl.

| | |
|---|---|
| ***B22D 39/00*** | (2006.01) |
| ***C22B 21/00*** | (2006.01) |
| ***C22B 21/06*** | (2006.01) |
| ***F27D 3/14*** | (2006.01) |
| ***F27D 27/00*** | (2010.01) |
| ***B22D 41/00*** | (2006.01) |

(52) U.S. Cl.

CPC ..... *C22B 21/0084* (2013.01); *C22B 21/064* (2013.01); *F27D 3/14* (2013.01); *F27D 27/005* (2013.01)

(58) Field of Classification Search

USPC ..... 266/236, 239, 900, 901, 251, 275; 75/686, 687; 222/590, 591, 594

See application file for complete search history.

(56) References Cited

U.S. PATENT DOCUMENTS 209,219 A 10/1878 Bookwalter
251,104 A 12/1881 Finch
307,845 A 11/1884 Curtis
364,804 A 6/1887 Cole
390,319 A 10/1888 Thomson
495,760 A 4/1893 Seitz
506,572 A 10/1893 Wagener
585,188 A 6/1897 Davis
757,932 A 4/1904 Jones
882,477 A 3/1908 Neumann
882,478 A 3/1908 Neumann
890,319 A 6/1908 Wells
898,499 A 9/1908 O'Donnell
909,774 A 1/1909 Flora
919,194 A 4/1909 Livingston
1,037,659 A 9/1912 Rembert
1,100,475 A 6/1914 Franckaerts
1,196,758 A 9/1916 Blair
1,304,068 A 5/1919 Krogh
1,331,997 A 2/1920 Neal
1,377,101 A 5/1921 Sparling
1,380,798 A 6/1921 Hansen et al.
1,439,365 A 12/1922 Hazell
1,454,967 A 5/1923 Gill
1,470,607 A 10/1923 Hazell
1,513,875 A 11/1924 Wilke
1,518,501 A 12/1924 Gill
1,522,765 A 1/1925 Wilke
1,526,851 A 2/1925 Hall
1,669,668 A 5/1928 Marshall
1,673,594 A 6/1928 Schmidt
1,697,202 A 1/1929 Nagle
1,717,969 A 6/1929 Goodner
1,718,396 A 6/1929 Wheeler
1,896,201 A 2/1933 Sterner-Rainer
1,988,875 A 1/1935 Saborio
2,013,455 A 9/1935 Baxter
2,038,221 A 4/1936 Kagi
2,090,162 A 8/1937 Tighe
2,091,677 A 8/1937 Fredericks
2,138,814 A 12/1938 Bressler
2,173,377 A 9/1939 Schultz, Jr. et al.
2,264,740 A 12/1941 Brown
2,280,979 A 4/1942 Rocke
2,290,961 A 7/1942 Heuer
2,300,688 A 11/1942 Nagle
2,304,849 A 12/1942 Ruthman
2,368,962 A 2/1945 Blom
2,383,424 A 8/1945 Stepanoff
2,423,655 A 7/1947 Mars et al.
2,488,447 A 11/1949 Tangen et al.
2,493,467 A 1/1950 Sunnen
2,515,097 A 7/1950 Schryber
2,515,478 A 7/1950 Tooley et al.
2,528,208 A 10/1950 Bonsack et al.
2,528,210 A 10/1950 Stewart
2,543,633 A 2/1951 Lamphere
2,566,892 A 9/1951 Jacobs
2,625,720 A 1/1953 Ross
2,626,086 A 1/1953 Forrest
2,676,279 A 4/1954 Wilson
2,677,609 A 5/1954 Moore et al.
2,698,583 A 1/1955 House et al.
2,714,354 A 8/1955 Farrand
2,762,095 A 9/1956 Pemetzrieder
2,768,587 A 10/1956 Corneil
2,775,348 A 12/1956 Williams
2,779,574 A 1/1957 Schneider
2,787,873 A 4/1957 Hadley
2,808,782 A 10/1957 Thompson et al.
2,809,107 A 10/1957 Russell
2,821,472 A 1/1958 Peterson et al.
2,824,520 A 2/1958 Bartels
2,832,292 A 4/1958 Edwards
2,839,006 A 6/1958 Mayo
2,853,019 A 9/1958 Thorton
2,865,295 A 12/1958 Nikolaus
2,865,618 A 12/1958 Abell
2,868,132 A 1/1959 Rittershofer
2,901,677 A 8/1959 Chessman et al.
2,906,632 A 9/1959 Nickerson
2,918,876 A 12/1959 Howe
2,948,524 A 8/1960 Sweeney et al.
2,958,293 A 11/1960 Pray, Jr.
2,978,885 A 4/1961 Davison
2,984,524 A 5/1961 Franzen
2,987,885 A 6/1961 Hodge
3,010,402 A 11/1961 King
3,015,190 A 1/1962 Arbeit
3,039,864 A 6/1962 Hess
3,044,408 A 7/1962 Mellott
3,048,384 A 8/1962 Sweeney et al.
3,070,393 A 12/1962 Silverberg et al.
3,092,030 A 6/1963 Wunder
3,099,870 A 8/1963 Seeler
3,128,327 A 4/1964 Upton
3,130,678 A 4/1964 Chenault
3,130,679 A 4/1964 Sence
3,171,357 A 3/1965 Egger
3,172,850 A 3/1965 Englesberg et al.
3,203,182 A 8/1965 Pohl
3,227,547 A 1/1966 Szekely
3,244,109 A 4/1966 Barske
3,251,676 A 5/1966 Johnson
3,255,702 A 6/1966 Gehrm
3,258,283 A 6/1966 Winberg et al.
3,272,619 A 9/1966 Sweeney et al.
3,289,473 A 12/1966 Louda
3,291,473 A 12/1966 Sweeney et al.
3,368,805 A 2/1968 Davey et al.
3,374,943 A 3/1968 Cervenka
3,400,923 A 9/1968 Howie et al.
3,417,929 A 12/1968 Secrest et al.
3,432,336 A 3/1969 Langrod
3,459,133 A 8/1969 Scheffler
3,459,346 A 8/1969 Tinnes
3,477,383 A 11/1969 Rawson et al.
3,487,805 A 1/1970 Satterthwaite
1,185,314 A 3/1970 London
3,512,762 A 5/1970 Umbricht
3,512,788 A 5/1970 Kilbane
3,737,305 A 12/1970 Blayden et al.
3,561,885 A 2/1971 Lake
3,575,525 A 4/1971 Fox et al.

(56) References Cited

U.S. PATENT DOCUMENTS 3,618,917 A 11/1971 Fredrikson
3,620,716 A 11/1971 Hess
3,650,730 A 3/1972 Derham et al.
3,689,048 A 9/1972 Foulard et al.
3,715,112 A 2/1973 Carbonnel
3,732,032 A 5/1973 Daneel
3,737,304 A 6/1973 Blayden
3,743,263 A 7/1973 Szekely
3,743,500 A 7/1973 Foulard et al.
3,753,690 A 8/1973 Emley et al.
3,759,628 A 9/1973 Kempf
3,759,635 A 9/1973 Carter et al.
3,767,382 A 10/1973 Bruno et al.
3,776,660 A 12/1973 Anderson et al.
3,785,632 A 1/1974 Kraemer et al.
3,787,143 A 1/1974 Carbonnel et al.
3,799,522 A 3/1974 Brant et al.
3,799,523 A 3/1974 Seki
3,807,708 A 4/1974 Jones
3,814,400 A 6/1974 Seki
3,824,028 A 7/1974 Zenkner et al.
3,824,042 A 7/1974 Barnes et al.
3,836,280 A 9/1974 Koch
3,839,019 A 10/1974 Bruno et al.
3,844,972 A 10/1974 Tully, Jr. et al.
3,871,872 A 3/1975 Downing et al.
3,873,073 A 3/1975 Baum et al.
3,873,305 A 3/1975 Claxton et al.
3,881,039 A 4/1975 Baldieri et al.
3,886,992 A 6/1975 Maas et al.
3,915,594 A 10/1975 Nesseth
3,915,694 A 10/1975 Ando
3,941,588 A 3/1976 Dremann
3,941,589 A 3/1976 Norman et al.
3,942,473 A 3/1976 Chodash
3,954,134 A 5/1976 Maas et al.
3,958,979 A 5/1976 Valdo
3,958,981 A 5/1976 Forberg et al.
3,961,778 A 6/1976 Carbonnel et al.
3,966,456 A 6/1976 Ellenbaum et al.
3,967,286 A 6/1976 Andersson et al.
3,972,709 A 8/1976 Chin et al.
3,973,871 A 8/1976 Hance
3,984,234 A * 10/1976 Claxton et al. ..... 75/671
3,985,000 A 10/1976 Hartz
3,997,336 A 12/1976 van Linden et al.
4,003,560 A 1/1977 Carbonnel
4,008,884 A 2/1977 Fitzpatrick et al.
4,018,598 A 4/1977 Markus
4,052,199 A 10/1977 Mangalick
4,055,390 A 10/1977 Young
4,063,849 A 12/1977 Modianos
4,068,965 A 1/1978 Lichti
4,073,606 A 2/1978 Eller
4,091,970 A 5/1978 Kimiyama et al.
4,119,141 A 10/1978 Thut et al.
4,125,146 A 11/1978 Muller
4,126,360 A 11/1978 Miller et al.
4,128,415 A 12/1978 van Linden et al.
4,169,584 A 10/1979 Mangalick
4,191,486 A 3/1980 Pelton
4,213,742 A 7/1980 Henshaw
4,242,039 A 12/1980 Villard et al.
4,244,423 A 1/1981 Thut et al.
4,286,985 A 9/1981 van Linden et al.
4,305,214 A 12/1981 Hurst
4,322,245 A 3/1982 Claxton
4,338,062 A 7/1982 Neal
4,347,041 A 8/1982 Cooper
4,351,514 A 9/1982 Koch
4,355,789 A 10/1982 Dolzhenkov et al.
4,356,940 A 11/1982 Ansorge
4,360,314 A 11/1982 Pennell
4,370,096 A 1/1983 Church
4,372,541 A 2/1983 Bocourt et al.
4,375,937 A 3/1983 Cooper
4,389,159 A 6/1983 Sarvanne
4,392,888 A 7/1983 Eckert et al.
4,410,299 A 10/1983 Shimoyama
4,419,049 A 12/1983 Gerboth et al.
4,456,424 A 6/1984 Araoka
4,470,846 A 9/1984 Dube
4,474,315 A 10/1984 Gilbert et al.
4,496,393 A 1/1985 Lustenberger
4,504,392 A 3/1985 Groteke
4,537,624 A 8/1985 Tenhover et al.
4,537,625 A 8/1985 Tenhover et al.
4,556,419 A 12/1985 Otsuka et al.
4,557,766 A 12/1985 Tenhover et al.
4,586,845 A 5/1986 Morris
4,592,700 A 6/1986 Toguchi et al.
4,594,052 A 6/1986 Niskanen
4,596,510 A 6/1986 Arneth et al.
4,598,899 A 7/1986 Cooper
4,600,222 A 7/1986 Appling
4,607,825 A 8/1986 Briolle et al.
4,609,442 A 9/1986 Tenhover et al.
4,611,790 A 9/1986 Otsuka et al.
4,617,232 A 10/1986 Chandler et al.
4,634,105 A 1/1987 Withers et al.
4,640,666 A 2/1987 Sodergard
4,655,610 A 4/1987 Al-Jaroudi
4,673,434 A 6/1987 Withers et al.
4,684,281 A 8/1987 Patterson
4,685,822 A 8/1987 Pelton
4,696,703 A 9/1987 Henderson et al.
4,701,226 A 10/1987 Henderson et al.
4,702,768 A 10/1987 Areauz et al.
4,714,371 A 12/1987 Cuse
4,717,540 A 1/1988 McRae et al.
4,739,974 A 4/1988 Mordue
4,743,428 A 5/1988 McRae et al.
4,747,583 A 5/1988 Gordon et al.
4,767,230 A 8/1988 Leas, Jr.
4,770,701 A 9/1988 Henderson et al.
4,786,230 A * 11/1988 Thut ..... 415/88
4,802,656 A 2/1989 Hudault et al.
4,804,168 A 2/1989 Otsuka et al.
4,810,314 A 3/1989 Henderson et al.
4,834,573 A 5/1989 Asano et al.
4,842,227 A 6/1989 Harrington et al.
4,844,425 A 7/1989 Piras et al.
4,851,296 A 7/1989 Tenhover et al.
4,859,413 A 8/1989 Harris et al.
4,867,638 A 9/1989 Handtmann et al.
4,884,786 A 12/1989 Gillespie
4,898,367 A 2/1990 Cooper
4,908,060 A 3/1990 Duenkelmann
4,923,770 A 5/1990 Grasselli et al.
4,930,986 A 6/1990 Cooper
4,931,091 A 6/1990 Waite et al.
4,940,214 A 7/1990 Gillespie
4,940,384 A 7/1990 Amra et al.
4,954,167 A 9/1990 Cooper
4,973,433 A 11/1990 Gilbert et al.
4,986,736 A 1/1991 Kajiwara
5,015,518 A 5/1991 Sasaki et al.
5,025,198 A 6/1991 Mordue et al.
5,028,211 A 7/1991 Mordue et al.
5,029,821 A 7/1991 Bar-on et al.
5,078,572 A 1/1992 Amra et al.
5,080,715 A 1/1992 Provencher et al.
5,083,753 A 1/1992 Soofie
5,088,893 A 2/1992 Gilbert et al.
5,092,821 A 3/1992 Gilbert et al.
5,098,134 A 3/1992 Monckton
5,114,312 A 5/1992 Stanislao
5,126,047 A 6/1992 Martin et al.
5,131,632 A 7/1992 Olson
5,143,357 A 9/1992 Gilbert et al.
5,145,322 A 9/1992 Senior, Jr. et al.
5,152,631 A 10/1992 Bauer
5,154,652 A 10/1992 Ecklesdafer
5,158,440 A 10/1992 Cooper et al.

(56) References Cited

U.S. PATENT DOCUMENTS 5,162,858 A 11/1992 Shoji et al.
5,165,858 A 11/1992 Gilbert et al.
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,388,633 A 2/1995 Mercer, II et al.
5,395,405 A 3/1995 Nagel et al.
5,399,074 A 3/1995 Nose et al.
5,407,294 A 4/1995 Giannini
5,411,240 A 5/1995 Rapp et al.
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,495,746 A 3/1996 Sigworth
5,505,143 A 4/1996 Nagel
5,505,435 A 4/1996 Laszlo
5,509,791 A 4/1996 Turner
5,511,766 A 4/1996 Vassillicos
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A 9/1996 Mordue et al.
5,571,486 A 11/1996 Robert et al.
5,585,532 A 12/1996 Nagel
5,586,863 A 12/1996 Gilbert et al.
5,591,243 A 1/1997 Colussi et al.
5,597,289 A 1/1997 Thut
5,613,245 A 3/1997 Robert
5,616,167 A 4/1997 Eckert
5,622,481 A 4/1997 Thut
5,629,464 A 5/1997 Bach et al.
5,634,770 A 6/1997 Gilbert et al.
5,640,706 A 6/1997 Nagel et al.
5,640,707 A 6/1997 Nagel et al.
5,640,709 A 6/1997 Nagel et al.
5,655,849 A 8/1997 McEwen et al.
5,660,614 A 8/1997 Waite et al.
5,662,725 A 9/1997 Cooper
5,676,520 A 10/1997 Thut
5,678,244 A 10/1997 Shaw et al.
5,678,807 A 10/1997 Cooper
5,679,132 A 10/1997 Rauenzahn et al.
5,685,701 A 11/1997 Chandler et al.
5,690,888 A 11/1997 Robert
5,695,732 A 12/1997 Sparks et al.
5,716,195 A 2/1998 Thut
5,717,149 A 2/1998 Nagel et al.
5,718,416 A 2/1998 Flisakowski et al.
5,735,668 A 4/1998 Klein
5,735,935 A 4/1998 Areaux
5,741,422 A 4/1998 Eichenmiller et al.
5,744,117 A 4/1998 Wilkinson et al.
5,745,861 A 4/1998 Bell et al.
5,772,324 A 6/1998 Falk
5,776,420 A 7/1998 Nagel
5,785,494 A 7/1998 Vild et al.
5,842,832 A 12/1998 Thut
5,858,059 A 1/1999 Abramovich et al.
5,863,314 A 1/1999 Morando
5,866,095 A 2/1999 McGeever et al.
5,875,385 A 2/1999 Stephenson et al.
5,935,528 A 8/1999 Stephenson et al.
5,944,496 A 8/1999 Cooper
5,947,705 A 9/1999 Mordue et al.
5,951,243 A 9/1999 Cooper
5,961,285 A 10/1999 Meneice et al.
5,963,580 A 10/1999 Eckert
5,992,230 A 11/1999 Scarpa et al.
5,993,726 A 11/1999 Huang
5,993,728 A 11/1999 Vild
6,019,576 A 2/2000 Thut
6,027,685 A 2/2000 Cooper
6,036,745 A 3/2000 Gilbert et al.
6,074,455 A 6/2000 van Linden et al.
6,082,965 A 7/2000 Morando
6,093,000 A 7/2000 Cooper
6,096,109 A 8/2000 Nagel et al.
6,113,154 A 9/2000 Thut
6,123,523 A 9/2000 Cooper
6,152,691 A 11/2000 Thut
6,168,753 B1 1/2001 Morando
6,187,096 B1 2/2001 Thut
6,199,836 B1 3/2001 Rexford et al.
6,217,823 B1 4/2001 Vild et al.
6,231,639 B1 5/2001 Eichenmiller
6,250,881 B1 6/2001 Mordue et al.
6,254,340 B1 7/2001 Vild et al.
6,270,717 B1 8/2001 Tremblay et al.
6,280,157 B1 8/2001 Cooper
6,293,759 B1 9/2001 Thut
6,303,074 B1 * 10/2001 Cooper ..... 266/235
6,345,964 B1 2/2002 Cooper
6,354,796 B1 3/2002 Morando
6,358,467 B1 3/2002 Mordue
6,364,930 B1 4/2002 Koss
6,371,723 B1 4/2002 Grant et al.
6,398,525 B1 6/2002 Cooper
6,439,860 B1 8/2002 Greer
6,451,247 B1 9/2002 Mordue et al.
6,457,940 B1 10/2002 Lehman
6,457,950 B1 10/2002 Cooper et al.
6,464,458 B2 10/2002 Vild et al.
6,497,559 B1 12/2002 Grant
6,500,228 B1 * 12/2002 Klingensmith et al. ..... 75/386
6,503,292 B2 1/2003 Klingensmith et al.
6,524,066 B2 2/2003 Thut
6,533,535 B2 3/2003 Thut
6,551,060 B2 4/2003 Mordue et al.
6,562,286 B1 5/2003 Lehman
6,656,415 B2 12/2003 Kos
6,679,936 B2 1/2004 Quackenbush
6,689,310 B1 2/2004 Cooper
6,709,234 B2 3/2004 Gilbert et al.
6,723,276 B1 4/2004 Cooper
6,805,834 B2 10/2004 Thut
6,843,640 B2 1/2005 Mordue et al.
6,848,497 B2 2/2005 Sale et al.
6,869,271 B2 3/2005 Gilbert et al.
6,869,564 B2 3/2005 Gilbert et al.
6,881,030 B2 4/2005 Thut
6,887,424 B2 5/2005 Ohno et al.
6,887,425 B2 5/2005 Mordue et al.
6,902,696 B2 6/2005 Klingensmith et al.
7,037,462 B2 5/2006 Klingensmith et al.
7,083,758 B2 8/2006 Tremblay
7,131,482 B2 11/2006 Vincent et al.

(56) References Cited

U.S. PATENT DOCUMENTS

| | | | | |
|---|---|---|---|---|
| 7,157,043 | B2 | 1/2007 | Neff | |
| 7,279,128 | B2 | 10/2007 | Kennedy et al. | |
| 7,326,028 | B2 | 2/2008 | Morando | |
| 7,402,276 | B2 | 7/2008 | Cooper | |
| 7,470,392 | B2 | 12/2008 | Cooper | |
| 7,476,357 | B2 | 1/2009 | Thut | |
| 7,497,988 | B2 | 3/2009 | Thut | |
| 7,507,367 | B2 | 3/2009 | Cooper | |
| 7,543,605 | B1 | 6/2009 | Morando | |
| 7,731,891 | B2 | 6/2010 | Cooper | |
| 7,906,068 | B2 | 3/2011 | Cooper | |
| 8,110,141 | B2 | 2/2012 | Cooper | |
| 8,137,023 | B2 | 3/2012 | Greer | |
| 8,142,145 | B2 | 3/2012 | Thut | |
| 8,178,037 | B2 | 5/2012 | Cooper | |
| 8,328,540 | B2 | 12/2012 | Wang | |
| 8,333,921 | B2 | 12/2012 | Thut | |
| 8,337,746 | B2 | 12/2012 | Cooper | |
| 8,361,379 | B2 | 1/2013 | Cooper | |
| 8,366,993 | B2 | 2/2013 | Cooper | |
| 8,409,495 | B2 | 4/2013 | Cooper | |
| 8,440,135 | B2 | 5/2013 | Cooper | |
| 8,444,911 | B2 | 5/2013 | Cooper | |
| 8,449,814 | B2 | 5/2013 | Cooper | |
| 8,475,594 | B2 | 7/2013 | Bright et al. | |
| 8,475,708 | B2 | 7/2013 | Cooper | |
| 8,480,950 | B2 | 7/2013 | Jetten et al. | |
| 8,501,084 | B2 | 8/2013 | Cooper | |
| 8,524,146 | B2 | 9/2013 | Cooper | |
| 8,529,828 | B2 | 9/2013 | Cooper | |
| 8,535,603 | B2 | 9/2013 | Cooper | |
| 8,580,218 | B2 | 11/2013 | Turenne et al. | |
| 8,613,884 | B2 | 12/2013 | Cooper | |
| 8,714,914 | B2 | 5/2014 | Cooper | |
| 8,753,563 | B2 | 6/2014 | Cooper | |
| 8,840,359 | B2 | 9/2014 | Vick et al. | |
| 8,899,932 | B2 | 12/2014 | Tetkoskie et al. | |
| 8,915,830 | B2 | 12/2014 | March et al. | |
| 8,920,680 | B2 | 12/2014 | Mao | |
| 9,011,761 | B2 | 4/2015 | Cooper | |
| 9,017,597 | B2 | 4/2015 | Cooper | |
| 9,034,244 | B2 | 5/2015 | Cooper | |
| 9,080,577 | B2 | 7/2015 | Cooper | |
| 9,108,244 | B2 | 8/2015 | Cooper | |
| 9,156,087 | B2 * | 10/2015 | Cooper | B22D 37/00 |
| 9,193,532 | B2 | 11/2015 | March et al. | |
| 9,205,490 | B2 * | 12/2015 | Cooper | B22D 37/00 |
| 9,234,520 | B2 | 1/2016 | Morando | |
| 1,170,512 | A1 | 2/2016 | Chapman | |
| 9,273,376 | B2 | 3/2016 | Lutes et al. | |
| 9,328,615 | B2 | 5/2016 | Cooper | |
| 9,377,028 | B2 | 6/2016 | Cooper | |
| 9,382,599 | B2 | 7/2016 | Cooper | |
| 9,383,140 | B2 | 7/2016 | Cooper | |
| 9,409,232 | B2 * | 8/2016 | Cooper | B22D 41/50 |
| 9,410,744 | B2 | 8/2016 | Cooper | |
| 9,422,942 | B2 | 8/2016 | Cooper | |
| 9,435,343 | B2 | 9/2016 | Cooper | |
| 9,464,636 | B2 | 10/2016 | Cooper | |
| 9,470,239 | B2 | 10/2016 | Cooper | |
| 9,481,035 | B2 | 11/2016 | Cooper | |
| 9,482,469 | B2 | 11/2016 | Cooper | |
| 9,506,129 | B2 | 11/2016 | Cooper | |
| 2001/0000465 | A1 | 4/2001 | Thut | |
| 2002/0146313 | A1 | 10/2002 | Thut | |
| 2002/0185790 | A1 | 12/2002 | Klingensmith | |
| 2002/0185794 | A1 | 12/2002 | Vincent | |
| 2003/0047850 | A1 | 3/2003 | Areaux | |
| 2003/0075844 | A1 | 4/2003 | Mordue et al. | |
| 2003/0082052 | A1 | 5/2003 | Gilbert et al. | |
| 2003/0201583 | A1 | 10/2003 | Klingensmith | |
| 2004/0050525 | A1 | 3/2004 | Kennedy et al. | |
| 2004/0076533 | A1 | 4/2004 | Cooper | |
| 2004/0115079 | A1 | 6/2004 | Cooper | |
| 2004/0262825 | A1 | 12/2004 | Cooper | |
| 2005/0013713 | A1 | 1/2005 | Cooper | |
| 2005/0013714 | A1 | 1/2005 | Cooper | |
| 2005/0013715 | A1 | 1/2005 | Cooper | |
| 2005/0053499 | A1 | 3/2005 | Cooper | |
| 2005/0077730 | A1 | 4/2005 | Thut | |
| 2005/0116398 | A1 | 6/2005 | Tremblay | |
| 2006/0180963 | A1 | 8/2006 | Thut | |
| 2007/0253807 | A1 | 11/2007 | Cooper | |
| 2008/0213111 | A1 | 9/2008 | Cooper | |
| 2008/0230966 | A1 | 9/2008 | Cooper | |
| 2008/0253905 | A1 | 10/2008 | Morando et al. | |
| 2008/0304970 | A1 | 12/2008 | Cooper | |
| 2008/0314548 | A1 | 12/2008 | Cooper | |
| 2009/0054167 | A1 | 2/2009 | Cooper | |
| 2009/0269191 | A1 | 10/2009 | Cooper | |
| 2010/0104415 | A1 | 4/2010 | Morando | |
| 2010/0200354 | A1 | 8/2010 | Yagi et al. | |
| 2011/0133374 | A1 | 6/2011 | Cooper | |
| 2011/0140319 | A1 | 6/2011 | Cooper | |
| 2011/0142603 | A1 | 6/2011 | Cooper | |
| 2011/0142606 | A1 | 6/2011 | Cooper | |
| 2011/0148012 | A1 | 6/2011 | Cooper | |
| 2011/0163486 | A1 | 7/2011 | Cooper | |
| 2011/0210232 | A1 | 9/2011 | Cooper | |
| 2011/0220771 | A1 | 9/2011 | Cooper | |
| 2011/0303706 | A1 | 12/2011 | Cooper | |
| 2012/0003099 | A1 | 1/2012 | Tetkoskie | |
| 2012/0163959 | A1 | 6/2012 | Morando | |
| 2013/0105102 | A1 | 5/2013 | Cooper | |
| 2013/0142625 | A1 | 6/2013 | Cooper | |
| 2013/0214014 | A1 | 8/2013 | Cooper | |
| 2013/0224038 | A1 | 8/2013 | Tetkoskie | |
| 2013/0292426 | A1 | 11/2013 | Cooper | |
| 2013/0292427 | A1 | 11/2013 | Cooper | |
| 2013/0299524 | A1 | 11/2013 | Cooper | |
| 2013/0299525 | A1 | 11/2013 | Cooper | |
| 2013/0306687 | A1 | 11/2013 | Cooper | |
| 2013/0334744 | A1 | 12/2013 | Tremblay | |
| 2013/0343904 | A1 | 12/2013 | Cooper | |
| 2014/0041252 | A1 | 2/2014 | Vild et al. | |
| 2014/0044520 | A1 | 2/2014 | Tipton | |
| 2014/0083253 | A1 | 3/2014 | Lutes et al. | |
| 2014/0210144 | A1 | 7/2014 | Torres et al. | |
| 2014/0232048 | A1 | 8/2014 | Howitt et al. | |
| 2014/0252701 | A1 | 9/2014 | Cooper | |
| 2014/0261800 | A1 | 9/2014 | Cooper | |
| 2014/0265068 | A1 | 9/2014 | Cooper | |
| 2014/0271219 | A1 | 9/2014 | Cooper | |
| 2014/0363309 | A1 | 12/2014 | Henderson et al. | |
| 2015/0069679 | A1 | 3/2015 | Henderson et al. | |
| 2015/0192364 | A1 | 7/2015 | Cooper | |
| 2015/0217369 | A1 | 8/2015 | Cooper | |
| 2015/0219112 | A1 | 8/2015 | Cooper | |
| 2015/0219113 | A1 | 8/2015 | Cooper | |
| 2015/0219114 | A1 | 8/2015 | Cooper | |
| 2015/0224574 | A1 | 8/2015 | Cooper | |
| 2015/0252807 | A1 | 9/2015 | Cooper | |
| 2015/0285557 | A1 | 10/2015 | Cooper | |
| 2015/0285558 | A1 | 10/2015 | Cooper | |
| 2015/0323256 | A1 | 11/2015 | Cooper | |
| 2015/0328682 | A1 | 11/2015 | Cooper | |
| 2015/0328683 | A1 | 11/2015 | Cooper | |
| 2016/0031007 | A1 | 2/2016 | Cooper | |
| 2016/0047602 | A1 | 2/2016 | Cooper | |
| 2016/0053762 | A1 | 2/2016 | Cooper | |
| 2016/0053814 | A1 | 2/2016 | Cooper | |
| 2016/0082507 | A1 | 3/2016 | Cooper | |
| 2016/0089718 | A1 | 3/2016 | Cooper | |
| 2016/0091251 | A1 | 3/2016 | Cooper | |
| 2016/0116216 | A1 | 4/2016 | Schlicht et al. | |
| 2016/0250686 | A1 | 9/2016 | Cooper | |
| 2016/0265535 | A1 | 9/2016 | Cooper | |

FOREIGN PATENT DOCUMENTS

| | | |
|---|---|---|
| CA | 2244251 | 12/1996 |
| CA | 2305865 | 2/2000 |
| CA | 2176475 | 7/2005 |
| CH | 392268 | 9/1965 |

(56) References Cited

FOREIGN PATENT DOCUMENTS

| | | |
|---|---|---|
| DE | 1800446 | 12/1969 |
| EP | 0168250 | 1/1986 |
| EP | 0665378 | 2/1995 |
| EP | 1019635 | 6/2006 |
| GB | 942648 | 11/1963 |
| GB | 1185314 | 3/1970 |
| GB | 2217784 | 3/1989 |
| JP | 58048796 | 3/1983 |
| JP | 63104773 | 5/1988 |
| JP | 5112837 | 5/1993 |
| MX | 227385 | 4/2005 |
| NO | 90756 | 1/1959 |
| RU | 416401 | 2/1974 |
| RU | 773312 | 10/1980 |
| WO | WO9808990 | 3/1998 |
| WO | WO9825031 | 6/1998 |
| WO | WO0009889 | 2/2000 |
| WO | WO0212147 | 2/2002 |
| WO | WO2004029307 | 4/2004 |
| WO | 2014055082 | 4/2014 |
| WO | 2014150503 | 9/2014 |
| WO | 2014185971 | 11/2014 |

OTHER PUBLICATIONS

USPTO; Notice of Reissue Examination Certificate dated Aug. 27, 2001 in U.S. Appl. No. 90/005,910.
"Response to Final Office Action and Request for Continued Examination for U.S. Appl. No. 09/275,627," Including Declarations of Haynes and Johnson, Apr. 16, 2001.
Document No. 504217: Excerpts from "Pyrotek Inc.'s Motion for Summary Judgment of Invalidity and Unenforceability of U.S. Pat. No. 7,402,276," Oct. 2, 2009.
Document No. 505026: Excerpts from "MMEI's Response to Pyrotek's Motion for Summary Judgment of Invalidity or Enforceability of U.S. Pat. No. 7,402,276," Oct. 9, 2009.
Document No. 507689: Excerpts from "MMEI's Pre-Hearing Brief and Supplemental Motion for Summary Judgment of Infringement of Claims 3-4, 15, 17-20, 26 and 28-29 of the '074 Patent and Motion for Reconsideration of the Validity of Claims 7-9 of the '276 Patent," Nov. 4, 2009.
Document No. 517158: Excerpts from "Reasoned Award," Feb. 19, 2010.
Document No. 525055: Excerpts from "Molten Metal Equipment Innovations, Inc.'s Reply Brief in Support of Application to Confirm Arbitration Award and Opposition to Motion to Vacate," May 12, 2010.
USPTO; Office Action dated Feb. 23, 1996 in U.S. Appl. No. 08/439,739.
USPTO; Office Action dated Aug. 15, 1996 in U.S. Appl. No. 08/439,739.
USPTO; Advisory Action dated Nov. 18, 1996 in U.S. Appl. No. 08/439,739.
USPTO; Advisory Action dated Dec. 9, 1996 in U.S. Appl. No. 08/439,739.
USPTO; Notice of Allowance dated Jan. 17, 1997 in U.S. Appl. No. 08/439,739.
USPTO; Office Action dated Jul. 22, 1996 in U.S. Appl. No. 08/489,962.
USPTO; Office Action dated Jan. 6, 1997 in U.S. Appl. No. 08/489,962.
USPTO; Interview Summary dated Mar. 4, 1997 in U.S. Appl. No. 08/489,962.
USPTO; Notice of Allowance dated Mar. 27, 1997 in U.S. Appl. No. 08/489,962.
USPTO; Office Action dated Sep. 23, 1998 in U.S. Appl. No. 08/759,780.
USPTO; Interview Summary dated Dec. 30, 1998 in U.S. Appl. No. 08/789,780.
USPTO; Notice of Allowance dated Mar. 17, 1999 in U.S. Appl. No. 08/789,780.
USPTO; Office Action dated Jul. 23, 1998 in U.S. Appl. No. 08/889,882.
USPTO; Office Action dated Jan. 21, 1999 in U.S. Appl. No. 08/889,882.
USPTO; Notice of Allowance dated Mar. 17, 1999 in U.S. Appl. No. 08/889,882.
USPTO; Office Action dated Feb. 26, 1999 in U.S. Appl. No. 08/951,007.
USPTO; Interview Summary dated Mar. 15, 1999 in U.S. Appl. No. 08/951,007.
USPTO; Office Action dated May 17, 1999 in U.S. Appl. No. 08/951,007.
USPTO; Notice of Allowance dated Aug. 27, 1999 in U.S. Appl. No. 08/951,007.
USPTO; Office Action dated Dec. 23, 1999 in U.S. Appl. No. 09/132,934.
USPTO; Notice of Allowance dated Mar. 9, 2000 in U.S. Appl. No. 09/132,934.
USPTO; Office Action dated Jan. 7, 2000 in U.S. Appl. No. 09/152,168.
USPTO; Notice of Allowance dated Aug. 7, 2000 in U.S. Appl. No. 09/152,168.
USPTO; Office Action dated Sep. 29, 1999 in U.S. Appl. No. 09/275,627.
USPTO; Office Action dated May 22, 2000 in U.S. Appl. No. 09/275,627.
USPTO; Office Action dated Nov. 14, 2000 in U.S. Appl. No. 09/275,627.
USPTO; Office Action dated May 21, 2001 in U.S. Appl. No. 09/275,627.
USPTO; Notice of Allowance dated Aug. 31, 2001 in U.S. Appl. No. 09/275,627.
USPTO; Office Action dated Jun. 15, 2000 in U.S. Appl. No. 09/312,361.
USPTO; Notice of Allowance dated Jan. 29, 2001 in U.S. Appl. No. 09/312,361.
USPTO; Office Action dated Jun. 22, 2001 in U.S. Appl. No. 09/569,461.
USPTO; Office Action dated Oct. 12, 2001 in U.S. Appl. No. 09/569,461.
USPTO; Office Action dated May 3, 2002 in U.S. Appl. No. 09/569,461.
USPTO; Advisory Action dated May 14, 2002 in U.S. Appl. No. 09/569,461.
USPTO; Office Action dated Dec. 4, 2002 in U.S. Appl. No. 09/569,461.
USPTO; Interview Summary dated Jan. 14, 2003 in U.S. Appl. No. 09/569,461.
USPTO; Notice of Allowance dated Jun. 24, 2003 in U.S. Appl. No. 09/569,461.
USPTO; Office Action dated Nov. 21, 2000 in U.S. Appl. No. 09/590,108.
USPTO; Office Action dated May 22, 2001 in U.S. Appl. No. 09/590,108.
USPTO; Notice of Allowance dated Sep. 10, 2001 in U.S. Appl. No. 09/590,108.
USPTO; Office Action dated Jan. 30, 2002 in U.S. Appl. No. 09/649,190.
USPTO; Office Action dated Oct. 4, 2002 in U.S. Appl. No. 09/649,190.
USPTO; Office Action dated Apr. 18, 2003 in U.S. Appl. No. 09/649,190.
USPTO; Notice of Allowance dated Nov. 21, 2003 in U.S. Appl. No. 09/649,190.
USPTO; Office Action dated Jun. 7, 2006 in U.S. Appl. No. 10/619,405.
USPTO; Final Office Action dated Feb. 20, 2007 in U.S. Appl. No. 10/619,405.
USPTO; Office Action dated Oct. 9, 2007 in U.S. Appl. No. 10/619,405.

(56) References Cited

OTHER PUBLICATIONS

USPTO; Final Office Action dated May 29, 2008 in U.S. Appl. No. 10/619,405.
USPTO; Interview Summary Aug. 22, 2008 in U.S. Appl. No. 10/619,405.
USPTO; Ex Parte Quayle dated Sep. 12, 2008 in U.S. Appl. No. 10/619,405.
USPTO; Interview Summary dated Oct. 16, 2008 in U.S. Appl. No. 10/619,405.
USPTO; Notice of Allowance dated Nov. 14, 2008 in U.S. Appl. No. 10/619,405.
USPTO; Office Action dated Mar. 20, 2006 in U.S. Appl. No. 10/620,318.
USPTO; Office Action dated Nov. 16, 2006 in U.S. Appl. No. 10/620,318.
USPTO; Final Office Action dated Jul. 25, 2007 in U.S. Appl. No. 10/620,318.
USPTO; Office Action dated Feb. 12, 2008 in U.S. Appl. No. 10/620,318.
USPTO; Final Office Action dated Oct. 16, 2008 in U.S. Appl. No. 10/620,318.
USPTO; Office Action dated Feb. 25, 2009 in U.S. Appl. No. 10/620,318.
USPTO; Final Office Action dated Oct. 8, 2009 in U.S. Appl. No. 10/620,318.
USPTO; Notice of Allowance Jan. 26, 2010 in U.S. Appl. No. 10/620,318.
USPTO; Office Action dated Nov. 15, 2007 in U.S. Appl. No. 10/773,101.
USPTO; Office Action dated Jun. 27, 2006 in U.S. Appl. No. 10/773,102.
USPTO; Final Office Action dated Mar. 6, 2007 in U.S. Appl. No. 10/773,102.
USPTO; Office Action dated Oct. 11, 2007 in U.S. Appl. No. 10/773,102.
USPTO; Interview Summary dated Mar. 18, 2008 in U.S. Appl. No. 10/773,102.
USPTO; Notice of Allowance dated Apr. 18, 2008 in U.S. Appl. No. 10/773,102.
USPTO; Office Action dated Jul. 24, 2006 in U.S. Appl. No. 10/773,105.
USPTO; Office Action dated Oct. 9, 2007 in U.S. Appl. No. 10/773,105.
USPTO; Interview Summary dated Jan. 25, 2008 in U.S. Appl. No. 10/773,105.
USPTO; Office Action dated May 19, 2008 in U.S. Appl. No. 10/773,105.
USPTO; Interview Summary dated Jul. 21, 2008 in U.S. Appl. No. 10/773,105.
USPTO; Notice of Allowance dated Sep. 29, 2008 in U.S. Appl. No. 10/773,105.
USPTO; Office Action dated Jan. 31, 2008 in U.S. Appl. No. 10/773,118.
USPTO; Final Office Action dated Aug. 18, 2008 in U.S. Appl. No. 10/773,118.
USPTO; Interview Summary dated Oct. 16, 2008 in U.S. Appl. No. 10/773,118.
USPTO; Office Action dated Dec. 15, 2008 in U.S. Appl. No. 10/773,118.
USPTO; Final Office Action dated May 1, 2009 in U.S. Appl. No. 10/773,118.
USPTO; Office Action dated Jul. 27, 2009 in U.S. Appl. No. 10/773,118.
USPTO; Final Office Action dated Feb. 2, 2010 in U.S. Appl. No. 10/773,118.
USPTO; Interview Summary dated Jun. 4, 2010 in U.S. Appl. No. 10/773,118.
USPTO; Ex Parte Quayle Action dated Aug. 25, 2010 in U.S. Appl. No. 10/773,118.
USPTO; Notice of Allowance dated Nov. 5, 2010 in U.S. Appl. No. 10/773,118.
USPTO; Office Action dated Mar. 16, 2005 in U.S. Appl. No. 10/827,941.
USPTO; Final Office Action dated Nov. 7, 2005 in U.S. Appl. No. 10/827,941.
USPTO; Office Action dated Jul. 12, 2006 in U.S. Appl. No. 10/827,941.
USPTO; Final Office Action dated Mar. 8, 2007 in U.S. Appl. No. 10/827,941.
USPTO; Office Action dated Oct. 29, 2007 in U.S. Appl. No. 10/827,941.
USPTO; Office Action dated Sep. 26, 2008 in U.S. Appl. No. 11/413,982.
USPTO; Office Action dated Dec. 11, 2009 in U.S. Appl. No. 11/766,617.
USPTO; Office Action dated Mar. 8, 2010 in U.S. Appl. No. 11/766,617.
USPTO; Final Office Action dated Sep. 20, 2010 in U.S. Appl. No. 11/766,617.
USPTO; Office Action dated Mar. 1, 2011 in U.S. Appl. No. 11/766,617.
USPTO; Final Office Action dated Sep. 22, 2011 in U.S. Appl. No. 11/766,617.
USPTO; Office Action dated Jan. 27, 2012 in U.S. Appl. No. 11/766,617.
USPTO; Notice of Allowance dated May 15, 2012 in U.S. Appl. No. 11/766,617.
USPTO; Supplemental Notice of Allowance dated Jul. 31, 2012 in U.S. Appl. No. 11/766,617.
USPTO; Notice of Allowance dated Aug. 24, 2012 in U.S. Appl. No. 11/766,617.
USPTO; Final Office Action dated Oct. 14, 2008 in U.S. Appl. No. 12/111,835.
USPTO; Office Action dated May 15, 2009 in U.S. Appl. No. 12/111,835.
USPTO; Office Action dated Mar. 31, 2009 in U.S. Appl. No. 12/120,190.
USPTO; Final Office Action dated Dec. 4, 2009 in U.S. Appl. No. 12/120,190.
USPTO; Office Action dated Jun. 28, 2010 in U.S. Appl. No. 12/120,190.
USPTO; Final Office Action dated Jan. 6, 2011 in U.S. Appl. No. 12/120,190.
USPTO; Office Action dated Jun. 27, 2011 in U.S. Appl. No. 12/120,190.
USPTO; Final Office Action dated Nov. 28, 2011 in U.S. Appl. No. 12/120,190.
USPTO; Notice of Allowance dated Feb. 6, 2012 in U.S. Appl. No. 12/120,190.
USPTO; Office Action dated Nov. 3, 2008 in U.S. Appl. No. 12/120,200.
USPTO; Final Office Action dated May 28, 2009 in U.S. Appl. No. 12/120,200.
USPTO; Office Action dated Dec. 18, 2009 in U.S. Appl. No. 12/120,200.
USPTO; Final Office Action dated Jul. 9, 2010 in U.S. Appl. No. 12/120,200.
USPTO; Office Action dated Jan. 21, 2011 in U.S. Appl. No. 12/120,200.
USPTO; Final Office Action dated Jul. 26, 2011 in U.S. Appl. No. 12/120,200.
USPTO; Final Office Action dated Feb. 3, 2012 in U.S. Appl. No. 12/120,200.
USPTO; Notice of Allowance dated Jan. 17, 2013 in U.S. Appl. No. 12/120,200.
USPTO; Office Action dated Jun. 16, 2009 in U.S. Appl. No. 12/146,770.
USPTO; Final Office Action dated Feb. 24, 2010 in U.S. Appl. No. 12/146,770.
USPTO; Office Action dated Jun. 9, 2010 in U.S. Appl. No. 12/146,770.

(56) References Cited

OTHER PUBLICATIONS

USPTO; Office Action dated Nov. 18, 2010 in U.S. Appl. No. 12/146,770.
USPTO; Final Office Action dated Apr. 4, 2011 in U.S. Appl. No. 12/146,770.
USPTO; Notice of Allowance dated Aug. 22, 2011 in U.S. Appl. No. 12/146,770.
USPTO; Notice of Allowance dated Nov. 1, 2011 in U.S. Appl. No. 12/146,770.
USPTO; Office Action dated Apr. 27, 2009 in U.S. Appl. No. 12/146,788.
USPTO; Final Office Action dated Oct. 15, 2009 in U.S. Appl. No. 12/146,788.
USPTO; Office Action dated Feb. 16, 2010 in U.S. Appl. No. 12/146,788.
USPTO; Final Office Action dated Jul. 13, 2010 in U.S. Appl. No. 12/146,788.
USPTO; Office Action dated Apr. 19, 2011 in U.S. Appl. No. 12/146,788.
USPTO; Notice of Allowance dated Aug. 19, 2011 in U.S. Appl. No. 12/146,788.
USPTO; Office Action dated Apr. 13, 2009 in U.S. Appl. No. 12/264,416.
USPTO; Final Office Action dated Oct. 8, 2009 in U.S. Appl. No. 12/264,416.
USPTO; Office Action dated Feb. 1, 2010 in U.S. Appl. No. 12/264,416.
USPTO; Final Office Action dated Jun. 30, 2010 in U.S. Appl. No. 12/264,416.
USPTO; Office Action dated Mar. 17, 2011 in U.S. Appl. No. 12/264,416.
USPTO; Final Office Action dated Jul. 7, 2011 in U.S. Appl. No. 12/264,416.
USPTO; Office Action dated Nov. 4, 2011 in U.S. Appl. No. 12/264,416.
USPTO; Final Office Action dated Jun. 8, 2012 in U.S. Appl. No. 12/264,416.
USPTO; Office Action dated Nov. 28, 2012 in U.S. Appl. No. 12/264,416.
USPTO; Ex Parte Quayle dated Apr. 3, 2013 in U.S. Appl. No. 12/264,416.
USPTO; Notice of Allowance dated Jun. 23, 2013 in U.S. Appl. No. 12/264,416.
USPTO; Office Action dated May 22, 2009 in U.S. Appl. No. 12/369,362.
USPTO; Final Office Action dated Dec. 14, 2009 in U.S. Appl. No. 12/369,362.
USPTO; Final Office Action dated Jun. 11, 2010 in U.S. Appl. No. 12/395,430.
USPTO; Office Action dated Nov. 24, 2010 in U.S. Appl. No. 12/395,430.
USPTO; Final Office Action dated Apr. 6, 2011 in U.S. Appl. No. 12/395,430.
USPTO; Office Action dated Aug. 18, 2011 in U.S. Appl. No. 12/395,430.
USPTO; Final Office Action dated Dec. 13, 2011 in U.S. Appl. No. 12/395,430.
USPTO; Advisory Action dated Feb. 22, 2012 in U.S. Appl. No. 12/395,430.
USPTO; Office Action dated Sep. 29, 2010 in U.S. Appl. No. 12/758,509.
USPTO; Final Office Action dated May 11, 2011 in U.S. Appl. No. 12/758,509.
USPTO; Office Action dated Feb. 1, 2012 in U.S. Appl. No. 12/853,201.
USPTO; Final Office Action dated Jul. 3, 2012 in U.S. Appl. No. 12/853,201.
USPTO; Notice of Allowance dated Jan. 31, 2013 in U.S. Appl. No. 12/853,201.
USPTO; Office Action dated Jan. 3, 2013 in U.S. Appl. No. 12/853,238.
USPTO; Office Action dated Dec. 18, 2013 in U.S. Appl. No. 12/853,238.
USPTO; Final Office Action dated Jun. 19, 2014 in U.S. Appl. No. 12/853,238.
USPTO; Office Action dated Feb. 27, 2012 in U.S. Appl. No. 12/853,253.
USPTO; Ex Parte Quayle Action dated Jun. 27, 2012 in U.S. Appl. No. 12/853,253.
USPTO; Notice of Allowance dated Oct. 2, 2012 in U.S. Appl. No. 12/853,253.
USPTO; Office Action dated Mar. 12, 2012 in U.S. Appl. No. 12/853,255.
USPTO; Final Office Action dated Jul. 24, 2012 in U.S. Appl. No. 12/853,255.
USPTO; Office Action dated Jan. 18, 2013 in U.S. Appl. No. 12/853,255.
USPTO; Notice of Allowance dated Jun. 20, 2013 in U.S. Appl. No. 12/853,255.
USPTO; Office Action dated Apr. 19, 2012 in U.S. Appl. No. 12/853,268.
USPTO; Final Office Action dated Sep. 17, 2012 in U.S. Appl. No. 12/853,268.
USPTO; Notice of Allowance dated Nov. 21, 2012 in U.S. Appl. No. 12/853,268.
USPTO; Office Action dated May 29, 2012 in U.S. Appl. No. 12/878,984.
USPTO; Office Action dated Oct. 3, 2012 in U.S. Appl. No. 12/878,984.
USPTO; Final Office Action dated Jan. 25, 2013 in U.S. Appl. No. 12/878,984.
USPTO; Notice of Allowance dated Mar. 28, 2013 in U.S. Appl. No. 12/878,984.
USPTO; Office Action dated Sep. 22, 2011 in U.S. Appl. No. 12/880,027.
USPTO; Final Office Action dated Feb. 16, 2012 in U.S. Appl. No. 12/880,027.
USPTO; Office Action dated Dec. 14, 2012 in U.S. Appl. No. 12/880,027.
USPTO; Final Office Action dated Jul. 11, 2013 in U.S. Appl. No. 12/880,027.
USPTO; Office Action dated Jul. 16, 2014 in U.S. Appl. No. 12/880,027.
USPTO; Office Action dated Dec. 18, 2013 in U.S. Appl. No. 12/895,796.
USPTO; Final Office Action dated Jun. 3, 2014 in U.S. Appl. No. 12/895,796.
USPTO; Office Action dated Aug. 25, 2011 in U.S. Appl. No. 13/047,719.
USPTO; Final Office Action dated Dec. 16, 2011 in U.S. Appl. No. 13/047,719.
USPTO; Office Action dated Sep. 11, 2012 in U.S. Appl. No. 13/047,719.
USPTO; Notice of Allowance dated Feb. 28, 2013 in U.S. Appl. No. 13/047,719.
USPTO; Office Action dated Aug. 25, 2011 in U.S. Appl. No. 13/047,747.
USPTO; Final Office Action dated Feb. 7, 2012 in U.S. Appl. No. 13/047,747.
USPTO; Notice of Allowance dated Apr. 18, 2012 in U.S. Appl. No. 13/047,747.
USPTO; Office Action dated Dec. 13, 2012 in U.S. Appl. No. 13/047,747.
USPTO; Notice of Allowance dated Apr. 3, 2013 in U.S. Appl. No. 13/047,747.
USPTO; Office Action dated Apr. 12, 2013 in U.S. Appl. No. 13/106,853.
USPTO; Notice of Allowance dated Aug. 23, 2013 in U.S. Appl. No. 13/106,853.
USPTO; Office Action dated Apr. 18, 2012 in U.S. Appl. No. 13/252,145.

(56) References Cited

OTHER PUBLICATIONS

USPTO; Final Office Action dated Sep. 17, 2012 in U.S. Appl. No. 13/252,145.
USPTO; Notice of Allowance dated Nov. 30, 2012 in U.S. Appl. No. 13/252,145.
USPTO; Office Action dated Aug. 1, 2013 in U.S. Appl. No. 12/877,988.
USPTO; Notice of Allowance dated Dec. 24, 2013 in U.S. Appl. No. 12/877,988.
USPTO; Office Action dated Sep. 6, 2013 in U.S. Appl. No. 13/725,383.
USPTO; Office Action dated Oct. 24, 2013 in U.S. Appl. No. 13/725,383.
USPTO; Final Office Action dated Mar. 25, 2014 in U.S. Appl. No. 13/725,383.
USPTO; Office Action dated Sep. 18, 2012 in U.S. Appl. No. 13/752,312.
USPTO; Final Office Action dated Jan. 27, 2014 in U.S. Appl. No. 13/752,312.
USPTO; Final Office Action dated May 23, 2014 in U.S. Appl. No. 13/752,312.
USPTO; Office Action dated Sep. 11, 2013 in U.S. Appl. No. 13/756,468.
USPTO; Notice of Allowance dated Feb. 3, 2014 in U.S. Appl. No. 13/756,468.
USPTO; Office Action dated Aug. 14, 2014 in U.S. Appl. No. 13/791,889.
CIPO; Office Action dated Dec. 4, 2001 in U.S. Pat. No. 2,115,929.
CIPO; Office Action dated Apr. 22, 2002 in U.S. Pat. No. 2,115,929.
CIPO; Notice of Allowance dated Jul. 18, 2003 in U.S. Pat. No. 2,115,929.
CIPO; Office Action dated Jun. 30, 2003 in U.S. Pat. No. 2,176,475.
CIPO; Notice of Allowance dated Sep. 15, 2004 in U.S. Pat. No. 2,176,475.
CIPO; Office Action dated May 29, 2000 in U.S. Pat. No. 2,242,174.
CIPO; Office Action dated Feb. 22, 2006 in U.S. Pat. No. 2,244,251.
CIPO; Office Action dated Mar. 27, 2007 in U.S. Pat. No. 2,244,251.
CIPO; Office Action dated Sep. 18, 2002 in U.S. Pat. No. 2,305,865.
CIPO; Notice of Allowance dated May 2, 2003 in U.S. Pat. No. 2,305,865.
EPO; Examination Report dated Oct. 6, 2008 in Application No. 08158682.
EPO; Office Action dated Jan. 26, 2010 in Application No. 08158682.
EPO; Office Action dated Feb. 15, 2011 in Application No. 08158682.
EPO; Search Report dated Nov. 9, 1998 in Application No. 98112356.
EPO; Office Action dated Feb. 6, 2003 in Application No. 99941032.
EPO; Office Action dated Aug. 20, 2004 in Application No. 99941032.
PCT; International Search Report or Declaration dated Nov. 15, 1999 in Application No. PCT/US1999/18178.
PCT; International Search Report or Declaration dated Oct. 9, 1998 in Application No. PCT/US1999/22440.
USPTO; Office Action dated Dec. 15, 2015 in U.S. Appl. No. 13/800,460.
USPTO; Ex Parte Quayle Action dated Jan. 25, 2016 in U.S. Appl. No. 13/843,947.
USPTO; Office Action dated Jan. 12, 2016 in U.S. Appl. No. 13/802,203.
USPTO; Ex Parte Quayle Action dated Nov. 4, 2015 in U.S. Appl. No. 14/027,237.
USPTO; Office Action dated Dec. 17, 2015 in U.S. Appl. No. 14/286,442.
USPTO; Office Action dated Dec. 23, 2015 in U.S. Appl. No. 14/662,100.
USPTO; Office Action dated Dec. 14, 2015 in U.S. Appl. No. 14/687,806.
USPTO; Office Action dated Dec. 18, 2015 in U.S. Appl. No. 14/689,879.
USPTO; Office Action dated Dec. 15, 2015 in U.S. Appl. No. 14/690,064.
USPTO; Office Action dated Dec. 31, 2015 in U.S. Appl. No. 14/690,099.
USPTO; Office Action dated Jan. 4, 2016 in U.S. Appl. No. 14/712,435.
USPTO; Office Action dated Mar. 31, 2015 in U.S. Appl. No. 12/853,238.
USPTO; Ex Parte Quayle Office Action dated Dec. 19, 2014 in U.S. Appl. No. 12/880,027.
USPTO; Notice of Allowance dated Apr. 8, 2015 in U.S. Appl. No. 12/880,027.
USPTO; Office Action dated Nov. 17, 2014 in U.S. Appl. No. 12/895,796.
USPTO; Office Action dated Sep. 1, 2015 in U.S. Appl. No. 12/895,796.
USPTO; Office Action dated Mar. 3, 2015 in U.S. Appl. No. 13/725,383.
USPTO; Office Action dated Nov. 20, 2015 in U.S. Appl. No. 13/725,383.
USPTO; Final Office Action dated Dec. 5, 2014 in U.S. Appl. No. 13/791,889.
USPTO; Office Action dated Sep. 23, 2014 in U.S. Appl. No. 13/843,947.
USPTO; Office Action dated Nov. 28, 2014 in U.S. Appl. No. 13/843,947.
USPTO; Final Office dated Apr. 10, 2015 in U.S. Appl. No. 13/843,947.
USPTO; Final Office Action dated Sep. 11, 2015 in U.S. Appl. No. 13/843,947.
USPTO; Notice of Allowance dated Jan. 30, 2015 in U.S. Appl. No. 13/830,031.
USPTO; Office Action dated Sep. 22, 2014 in U.S. Appl. No. 13/830,031.
USPTO; Final Office Action dated Mar. 3, 2015 in U.S. Appl. No. 13/838,601.
USPTO; Office Action dated Jul. 24, 2015 in U.S. Appl. No. 13/838,601.
USPTO; Office Action dated Sep. 15, 2014 in U.S. Appl. No. 13/797,616.
USPTO; Notice of Allowance dated Feb. 4, 2015 in U.S. Appl. No. 13/797.616.
USPTO; Restriction Requirement dated Sep. 17, 2014 in U.S. Appl. No. 13/801,907.
USPTO; Office Action dated Dec. 9, 2014 in U.S. Appl. No. 13/801,907.
USPTO; Notice of Allowance dated Jun. 5, 2015 in U.S. Appl. No. 13/801,907.
USPTO; Supplemental Notice of Allowance dated Oct. 2, 2015 in U.S. Appl. No. 13/801,907.
USPTO; Office Action dated Jan. 9, 2015 in U.S. Appl. No. 13/802,040.
USPTO; Notice of Allowance dated Jul. 14, 2015 in U.S. Appl. No. 13/802,040.
USPTO; Restriction Requirement dated Sep. 17, 2014 in U.S. Appl. No. 13/802,203.
USPTO; Office Action dated Dec. 11, 2014 in U.S. Appl. No. 13/802,203.
USPTO; Office Action dated Sep. 25, 2014 in U.S. Appl. No. 13/838,601.
USPTO; Office Action dated Feb. 13, 2015 in U.S. Appl. No. 13/973,962.
USPTO; Final Office Action dated Jul. 16, 2015 in U.S. Appl. No. 13/973,962.
USPTO; Office Action dated Apr. 10, 2015 in U.S. Appl. No. 14/027,237.
USPTO; Final Office Action dated Aug. 20, 2015 in U.S. Appl. No. 14/027,237.
USPTO; Notice of Allowance dated Nov. 24, 2015 in U.S. Appl. No. 13/973,962.

(56) References Cited

OTHER PUBLICATIONS

USPTO; Restriction Requirement dated Jun. 25, 2015 in U.S. Appl. No. 13/841,938.
USPTO; Office Action dated Aug. 25, 2015 in U.S. Appl. No. 13/841,938.
USPTO; Final Office Action dated Jul. 10, 2015 in U.S. Appl. No. 12/853,238.
USPTO; Final Office Action dated Jul. 10, 2015 in U.S. Appl. No. 13/725,383.
USPTO; Notice of Allowance dated Sep. 20, 2012 in U.S. Appl. No. 12/395,430.
USPTO; Office Action dated Jan. 20, 2016 in U.S. Appl. No. 12/853,238.
USPTO; Notice of Allowance dated Jan. 15, 2016 in U.S. Appl. No. 14/027,237.
USPTO; Office Action dated Feb. 11, 2016 in U.S. Appl. No. 14/690,174.
USPTO; Office Action dated Feb. 25, 2016 in U.S. Appl. No. 13/841,938.
USPTO; Notice of Allowance dated Mar. 8, 2016 in U.S. Appl. No. 13/973,962.
USPTO; Office Action dated Mar. 10, 2016 in U.S. Appl. No. 14/690,218.
USPTO; Notice of Allowance dated Mar. 11, 2016 in U.S. Appl. No. 13/843,947.
USPTO; Notice of Allowance dated Apr. 11, 2016 in U.S. Appl. No. 14/690,064.
USPTO; Notice of Allowance dated Apr. 12, 2016 in U.S. Appl. No. 14/027,237.
USPTO; Final Office Action dated May 2, 2016 in U.S. Appl. No. 14/687,806.
USPTO; Office action dated May 4, 2016 in U.S. Appl. No. 14/923,296.
USPTO; Notice of Allowance dated May 6, 2016 in U.S. Appl. No. 13/725,383.
USPTO; Notice of Allowance dated May 8, 2016 in U.S. Appl. No. 13/802,203.
USPTO; Office Action dated May 9, 2016 in U.S. Appl. No. 14/804,157.
USPTO; Office Action dated May 19, 2016 in U.S. Appl. No. 14/745,845.
USPTO; Office Action dated Jun. 6, 2016 in U.S. Appl. No. 14/808,935.
USPTO; Final Office Action dated Jun. 15, 2016 in U.S. Appl. No. 14/689,879.
USPTO; Notice of Allowance dated Jul. 7, 2016 in U.S. Appl. No. 14/804,157.
USPTO; Notice of Allowance dated Jul. 7, 2016 in U.S. Appl. No. 14/690,218.
USPTO; Notice of Allowance dated Jul. 7, 2016 in U.S. Appl. No. 14/690,099.
USPTO; Notice of Allowance dated Jul. 7, 2016 in U.S. Appl. No. 14/662,100.
USPTO; Notice of Allowance dated Jul. 20, 2016 in U.S. Appl. No. 14/715,435.
USPTO; Final Office Action dated Jul. 28, 2016 in U.S. Appl. No. 13/800,460.
USPTO; Office Action dated Aug. 1, 2016 in U.S. Appl. No. 15/153,735.
USPTO; Office Action dated Aug. 15, 2016 in U.S. Appl. No. 14/811,655.
USPTO; Office Action dated Aug. 17, 2016 in U.S. Appl. No. 14/959,758.
USPTO; Final Office Action dated Aug. 10, 2016 in U.S. Appl. No. 12/853,238.
USPTO; Final Office Action dated Aug. 26, 2016 in U.S. Appl. No. 14/923,296.
USPTO; Office Action dated Aug. 29, 2016 in U.S. Appl. No. 14/687,806.
USPTO; Final Office Action dated Sep. 15, 2016 in U.S. Appl. No. 14/745,845.
USPTO; Office Action dated Sep. 15, 2016 in U.S. Appl. No. 14/746,593.
USPTO; Notice of Allowance dated Sep. 28, 2016 in U.S. Appl. No. 14/918,471.
USPTO; Office Action dated Oct. 11, 2016 in U.S. Appl. No. 13/841,938.
USPTO; Office Action dated Oct. 27, 2016 in U.S. Appl. No. 14/689,879.
USPTO; Notice of Allowance dated Nov. 25, 2016 in U.S. Appl. No. 15/153,735.
USPTO; Notice of Allowance dated Nov. 29, 2016 in U.S. Appl. No. 14/808,935.

* cited by examiner

SECTION A-A

SECTION B-B

SECTION A-A

SECTION E-E

MOLTEN METAL TRANSFER AND DEGASSING SYSTEM

CROSS-REFERENCE TO RELATED APPLICATIONS

This application is a continuation-in-part of, and claims priority to, U.S. patent application Ser. No. 13/801,907 (Now U.S. Pat. No. 9,205,490), filed on Mar. 13, 2013 by Paul V. Cooper, U.S. patent application Ser. No. 13/802,040 (Now U.S. Pat. No. 9,156,087), filed on Mar. 13, 2013, by Paul V. Cooper, and U.S. patent application Ser. No. 13/802,203 (Now U.S. Pat. No. 9,409,232), filed on Mar. 13, 2013, by Paul V. Cooper, the disclosures of which that is not inconsistent with the present disclosure is incorporated herein by reference. This application is also a continuation-in-part of, and claims priority to U.S. patent application Ser. No. 13/725,383 (Now U.S. Pat. No. 9,383,140), filed on Dec. 21, 2012, by Paul V. Cooper, which is a divisional of, and claims priority to U.S. patent application Ser. No. 11/766,617 (Now U.S. Pat. No. 8,337,746), filed on Jun. 21, 2007, by Paul V. Cooper, the disclosure(s) of which that is not inconsistent with the present disclosure is incorporated herein by reference. This application incorporates by reference the portions of U.S. patent application Ser. No. 13/797,616 (Now U.S. Pat. No. 9,017,597), filed on Mar. 12, 2013, by Paul V. Cooper, U.S. patent application Ser. No. 08/489,962 (Now U.S. Pat. No. 5,678,807) filed Jun. 13, 1995, by Paul V. Cooper, U.S. patent application Ser. No. 12/853,255 (Now U.S. Pat. No. 8,535,603), filed Aug. 9, 2010, by Paul V. Cooper, U.S. patent application Ser. No. 12/878,984 (Now U.S. Pat. No. 8,524,146), filed Sep. 9, 2010, by Paul V. Cooper, U.S. patent application Ser. No. 12/880,027 (Now U.S. Pat. No. 9,108,244), filed Sep. 10, 2010, by Paul V. Cooper, and U.S. patent application Ser. No. 13/106,853 (Now U.S. Pat. No. 8,613,884), filed May 12, 2011, by Paul V. Cooper, and U.S. patent application Ser. No. 13/725,383 (Now U.S. Pat. No. 9,383,140) filed on Dec. 21, 2012, by Paul V. Cooper, that is not inconsistent with this disclosure.

FIELD OF THE INVENTION

The invention relates to a system for moving molten metal out of a vessel, and components used in such a system, and for degassing metal in a vessel and transferring it out of the vessel with little turbulence. Another aspect relates to a time saving method and system to perform maintenance on components with less risk of damaging the components.

BACKGROUND OF THE INVENTION

As used herein, the term "molten metal" means any metal or combination of metals in liquid form, such as aluminum, copper, iron, zinc and alloys thereof. The term "gas" means any gas or combination of gases, including argon, nitrogen, chlorine, fluorine, freon, and helium, that are released into molten metal.

Known molten-metal pumps include a pump base (also called a housing or casing), one or more inlets (an inlet being an opening in the housing to allow molten metal to enter a pump chamber), a pump chamber, which is an open area formed within the housing, and a discharge, which is a channel or conduit of any structure or type communicating with the pump chamber (in an axial pump the chamber and discharge may be the same structure or different areas of the same structure) leading from the pump chamber to an outlet, which is an opening formed in the exterior of the housing through which molten metal exits the casing. An impeller, also called a rotor, is mounted in the pump chamber and is connected to a drive system. The drive system is typically an impeller shaft connected to one end of a drive shaft, the other end of the drive shaft being connected to a motor. Often, the impeller shaft is comprised of graphite, the motor shaft is comprised of steel, and the two are connected by a coupling. As the motor turns the drive shaft, the drive shaft turns the impeller and the impeller pushes molten metal out of the pump chamber, through the discharge, out of the outlet and into the molten metal bath. Most molten metal pumps are gravity fed, wherein gravity forces molten metal through the inlet and into the pump chamber as the impeller pushes molten metal out of the pump chamber.

A number of submersible pumps used to pump molten metal (referred to herein as molten metal pumps) are known in the art. For example, U.S. Pat. No. 2,948,524 to Sweeney et al., U.S. Pat. No. 4,169,584 to Mangalick, U.S. Pat. No. 5,203,681 to Cooper, U.S. Pat. No. 6,093,000 to Cooper and U.S. Pat. No. 6,123,523 to Cooper, and U.S. Pat. No. 6,303,074 to Cooper, all disclose molten metal pumps. The disclosures of the patents to Cooper noted above are incorporated herein by reference. The term submersible means that when the pump is in use, its base is at least partially submerged in a bath of molten metal.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of the charging well where scrap metal is charged (i.e., added).

Transfer pumps are generally used to transfer molten metal from the external well of a reverbatory furnace to a different location such as a ladle or another furnace.

Gas-release pumps, such as gas-injection pumps, circulate molten metal while introducing a gas into the molten metal. In the purification of molten metals, particularly aluminum, it is frequently desired to remove dissolved gases such as hydrogen, or dissolved metals, such as magnesium. As is known by those skilled in the art, the removing of dissolved gas is known as "degassing" while the removal of magnesium is known as "demagging." Gas-release pumps may be used for either of these purposes or for any other application for which it is desirable to introduce gas into molten metal.

Gas-release pumps generally include a gas-transfer conduit having a first end that is connected to a gas source and a second end submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where molten metal enters the pump chamber.

Generally, a degasser (also called a rotary degasser) includes (1) an impeller shaft having a first end, a second end and a passage for transferring gas, (2) an impeller, and (3) a drive source for rotating the impeller shaft and the impeller. The first end of the impeller shaft is connected to the drive source and to a gas source and the second end is connected to the connector of the impeller. Examples of rotary degassers are disclosed in U.S. Pat. No. 4,898,367 entitled "Dispersing Gas Into Molten Metal," U.S. Pat. No. 5,678,807 entitled "Rotary Degassers," and U.S. Pat. No. 6,689,310 to Cooper entitled "Molten Metal Degassing Device and Impellers Therefore," filed May 12, 2000, the respective disclosures of which are incorporated herein by reference.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Generally a scrap melter includes an impeller affixed to an end of a drive shaft, and a drive source attached to the other end of the drive shaft for rotating the shaft and the impeller. The movement of the impeller draws molten metal and scrap metal downward into the molten metal bath in order to melt the scrap. A circulation pump is preferably used in conjunction with the scrap melter to circulate the molten metal in order to maintain a relatively constant temperature within the molten metal. Scrap melters are disclosed in U.S. Pat. No. 4,598,899 to Cooper, U.S. patent application Ser. No. 09/649,190 to Cooper, filed Aug. 28, 2000, and U.S. Pat. No. 4,930,986 to Cooper, the respective disclosures of which are incorporated herein by reference.

Molten metal transfer pumps have been used, among other things, to transfer molten aluminum from a well to a ladle or launder, wherein the launder normally directs the molten aluminum into a ladle or into molds where it is cast into solid, usable pieces, such as ingots. The launder is essentially a trough, channel or conduit outside of the reverbatory furnace. A ladle is a large vessel into which molten metal is poured from the furnace. After molten metal is placed into the ladle, the ladle is transported from the furnace area to another part of the facility where the molten metal inside the ladle is poured into other vessels, such as smaller holders or molds. A ladle is typically filled in two ways. First, the ladle may be filled by utilizing a transfer pump positioned in the furnace to pump molten metal out of the furnace, through a metal-transfer conduit and over the furnace wall, into the ladle or other vessel or structure. Second, the ladle may be filled by transferring molten metal from a hole (called a tap-out hole) located at or near the bottom of the furnace and into the ladle. The tap-out hole is typically a tapered hole or opening, usually about 1"-4" in diameter that receives a tapered plug called a "tap-out plug." The plug is removed from the tap-out hole to allow molten metal to drain from the furnace, and is inserted into the tap-out hole to stop the flow of molten metal out of the furnace.

There are problems with each of these known methods. Referring to filling a ladle utilizing a transfer pump, there is splashing (or turbulence) of the molten metal exiting the transfer pump and entering the ladle. This turbulence causes the molten metal to interact more with the air than would a smooth flow of molten metal pouring into the ladle. The interaction with the air leads to the formation of dross within the ladle and splashing also creates a safety hazard because persons working near the ladle could be hit with molten metal. Further, there are problems inherent with the use of most transfer pumps. For example, the transfer pump can develop a blockage in the riser, which is an extension of the pump discharge that extends out of the molten metal bath in order to pump molten metal from one structure into another. The blockage blocks the flow of molten metal through the pump and essentially causes a failure of the system. When such a blockage occurs the transfer pump must be removed from the furnace and the riser tube must be removed from the transfer pump and replaced. This causes hours of expensive downtime. A transfer pump also has associated piping attached to the riser to direct molten metal from the vessel containing the transfer pump into another vessel or structure. The piping is typically made of steel with an internal liner. The piping can be between 1 and 50 feet in length or even longer. The molten metal in the piping can also solidify causing failure of the system and downtime associated with replacing the piping.

If a tap-out hole is used to drain molten metal from a furnace a depression may be formed in the factory floor or other surface on which the furnace rests, and the ladle can preferably be positioned in the depression so it is lower than the tap-out hole, or the furnace may be elevated above the floor so the tap-out hole is above the ladle. Either method can be used to enable molten metal to flow using gravity from the tap-out hole into the ladle.

Use of a tap-out hole at the bottom of a furnace can lead to problems. First, when the tap-out plug is removed molten metal can splash or splatter causing a safety problem. This is particularly true if the level of molten metal in the furnace is relatively high which leads to a relatively high pressure pushing molten metal out of the tap-out hole. There is also a safety problem when the tap-out plug is reinserted into the tap-out hole because molten metal can splatter or splash onto personnel during this process. Further, after the tap-out hole is plugged, it can still leak. The leak may ultimately cause a fire, lead to physical harm of a person and/or the loss of a large amount of molten metal from the furnace that must then be cleaned up, or the leak and subsequent solidifying of the molten metal may lead to loss of the entire furnace.

Another problem with tap-out holes is that the molten metal at the bottom of the furnace can harden if not properly circulated thereby blocking the tap-out hole or the tap-out hole can be blocked by a piece of dross in the molten metal.

A launder may be used to pass molten metal from the furnace and into a ladle and/or into molds, such as molds for making ingots of cast aluminum. Several die cast machines, robots, and/or human workers may draw molten metal from the launder through openings (sometimes called plug taps). The launder may be of any dimension or shape. For example, it may be one to four feet in length, or as long as 100 feet in length. The launder is usually sloped gently, for example, it may historically be sloped downward at a slope of approximately ⅛ inch per each ten feet in length, in order to use gravity to direct the flow of molten metal out of the launder, either towards or away from the furnace, to drain all or part of the molten metal from the launder once the pump supplying molten metal to the launder is shut off. In use, a typical launder includes molten aluminum at a depth of approximately 1-10."

Whether feeding a ladle, launder or other structure or device utilizing a transfer pump, the pump is turned off and on according to when more molten metal is needed. This can be done manually or automatically. If done automatically, the pump may turn on when the molten metal in the ladle or launder is below a certain amount, which can be measured in any manner, such as by the level of molten metal in the launder or level or weight of molten metal in a ladle. A switch activates the transfer pump, which then pumps molten metal from the pump well, up through the transfer pump riser, and into the ladle or launder. The pump is turned off when the molten metal reaches a given amount in a given structure, such as a ladle or launder. This system suffers from the problems previously described when using transfer pumps. Further, when a transfer pump is utilized it must generally operate at a high speed (RPM) in order to generate enough pressure to push molten metal upward through the riser and into the ladle or launder. Therefore, there can be lags wherein there is no or too little molten metal exiting the transfer pump riser and/or the ladle or launder could be over filled because of a lag between detection of the desired amount having been reached, the transfer pump being shut off, and the cessation of molten metal exiting the transfer pump.

Furthermore, there are passive systems wherein molten metal is transferred from a vessel to another by the flow into the vessel causing the level in the vessel to rise to the point at which it reaches an output port, which is any opening that permits molten metal to exit the vessel. The problem with such a system is that thousands of pounds of molten metal can remain in the vessel, and the tap-out plug must be removed to drain it. When molten metal is drained using a tap-out plug, the molten metal fills another vessel, such as a sow mold, on the factory floor. First, turbulence is created when the molten metal pours from the tap-out plug opening and into such a vessel. This can cause dross to form and negate any degassing that had previously been done. Second, the vessel into which the molten metal is drained must then be moved and manipulated to remove molten metal from it prior to the molten metal hardening.

Thus, known methods of transferring molten metal from one vessel to another can result in thousands of pounds of a molten aluminum alloy left in the vessel, which could then harden. Or, the molten metal must be removed by utilizing a tap-out plug as described above.

It is preferred that a system having a transfer chamber according to the invention is more positively controlled than either: (1) A passive system, wherein molten metal flows into one side of a vessel and, as the level increases inside of the vessel, the level reaches a point at which the molten metal flows out of an outlet on the opposite side. Such a vessel may be tilted or have an angled inner bottom surface to help cause molten metal to flow towards the side that has the outlet. (2) A system utilizing a molten-metal transfer pump, because of the inherent problems with transfer pumps, which are generally described in this Background section.

Furthermore, launders into which molten metal exiting a vessel might flow have been angled downwards from the outlet of the vessel so that gravity helps drain the molten metal out of the launder. This was often necessary because launders were typically used in conjunction with tap-out plugs at the bottom of a vessel, and tap-out plugs are dimensionally relatively small, plus they have the pressure of the molten metal in the vessel behind them. Thus, molten metal in a launder could not flow backward into a tap-out plug. The problem with such a launder is that when exposed to the air, molten metal oxidizes and forms dross, which in a launder appears as a semi-solid or solid skin on the surface of the molten metal. When the launder is angled downwards, the dross, or skin, is usually pulled into the molten metal flow and into whatever downstream vessel is being filled. This creates contamination in the finished product.

Finally, it is known in the art to degas molten metal using a device called a rotary degasser. Such devices are disclosed in some of the disclosures incorporated by reference above. Although these devices generally work well, frequently the degassed molten metal, which is typically molten aluminum, experiences turbulence when moved from the degassing chamber into another chamber or vessel, which adds gas (particularly air) into the molten metal thereby creating air pockets and dross that are undesirable for finished products. Additionally, the flow rate of metal out of such devices often varies depending upon the flow rate into them. Consequently, a need exists for a better degassing system that generates little turbulence when transferring molten metal from the degassing chamber to another vessel, and that may also maintain a constant flow out of the vessel regardless of the flow rate into the vessel.

SUMMARY OF THE INVENTION

The invention relates to systems and methods for transferring molten metal from one structure to another. Aspects of the invention include a transfer chamber constructed inside of or next to a vessel used to retain molten metal. The transfer chamber is in fluid communication with the vessel so molten metal from the vessel can enter the transfer chamber. In certain embodiments, inside of the transfer chamber is a powered device that moves molten metal upward and out of the transfer chamber and preferably into a structure outside of the vessel, such as another vessel or a launder.

In one embodiment, the powered device is a type of molten metal pump designed to work in the transfer chamber. The pump includes a motor and a drive shaft connected to a rotor. The pump may or may not include a pump base or support posts. The rotor is designed to drive molten metal upwards through an enclosed section of the transfer chamber, and fits into the transfer chamber in such a manner as to utilize part of the transfer chamber structure as a pump chamber to create the necessary pressure to move molten metal upwards as the rotor rotates. As the system is utilized, it moves molten metal upward through the transfer structure where it exits through an outlet.

A key advantage of the present system is that the amount of molten metal entering the launder, and the level in the launder, can remain constant regardless of the amount of or level of molten metal entering the transfer chamber with prior art systems, the metal level in the transfer chamber rises and falls and can affect the molten metal level in the launder. Alternatively, the molten metal can be removed from the vessel utilizing a tap-out plug, which is associated with the problems previously described.

The system may be used in combination with a circulation or gas-release (also called a gas-injection) pump that moves molten metal in the vessel towards the transfer structure. Alternatively, a circulation or gas-release pump may be used with or without the pump in the transfer chamber, in which case the pump may be utilized with a wall that separates the vessel into two or more sections with the circulation pump in one of the sections, and the transfer chamber in another section. There would then be an opening in the wall in communication with the pump discharge. As the pump operates it would move molten metal through the opening in the wall and into the section of the vessel containing the transfer chamber. The molten metal level in that section would then rise until it exits an outlet in communication with the transfer chamber.

In an alternate embodiment, a molten metal pump is utilized that has a pump base and a riser tube that directs molten metal upward into the enclosed structure (or uptake section) of the transfer chamber, wherein the pressure generated by the pump pushes the molten metal upward through the riser tube, through the enclosed structure and out of an outlet in communication with the transfer chamber.

Also described herein is a transfer chamber and a rotor that can be used in the practice of the invention.

It has also been discovered that by making the launder either level (i.e., at a 0° incline) or inclined backwards towards the vessel so that molten metal in the launder drains back into the vessel, the dross or skin that forms on the surface of the molten metal in the launder is not pulled away with the molten metal entering downstream vessels. Thus, this dross is less likely to contaminate any finished product, which is a substantial benefit. Preferably, a launder according to the inventor is formed at a horizontal angle leaning back towards the vessel of 0° to 10°, or 0° to 5°, or 0° to 3°, or 1° to 3°, or at a slope of about ⅛" for every 10' of launder.

Also, a system according to the invention may include one or more degassers in a vessel (preferably a plurality of degassers) wherein each degasser is preferably in a separate compartment in communication with one or more other degasser compartments (if multiple degassers are used). The degassers degas the molten metal and the molten metal moves out of the system in a low-turbulence stream generated by a transfer pump system according to the invention, which helps to maintain a relatively constant flow out of the vessel.

Further, other aspects of the invention include a simple, time-saving method and system to remove components from a vessel to perform maintenance and to place them back into the vessel while reducing the likelihood of damaging the components.

DETAILED DESCRIPTION OF PREFERRED EMBODIMENTS

Figure 1:
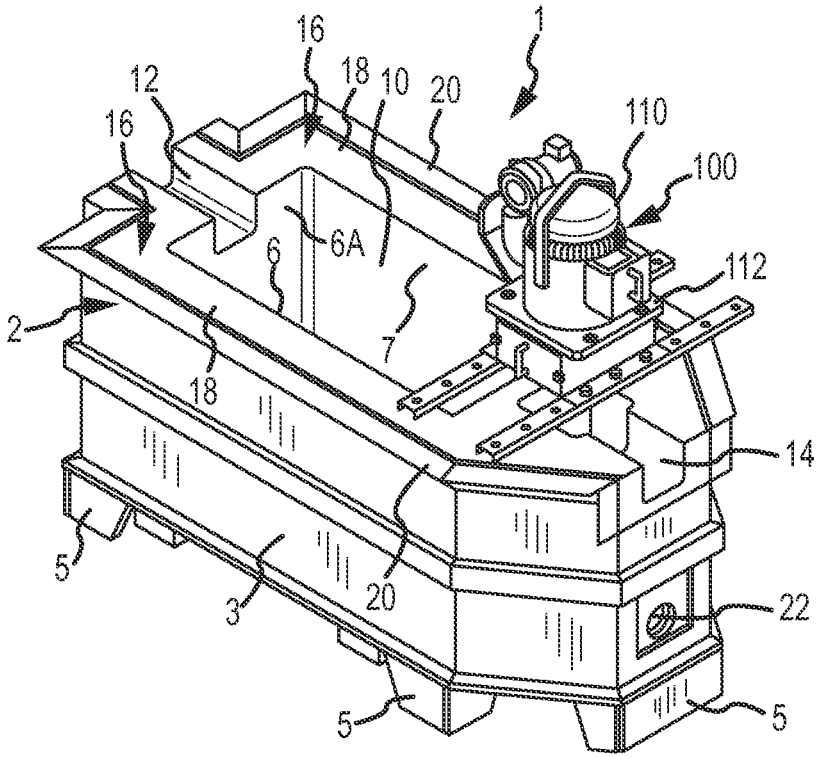
FIG. 1 is a top, perspective view of a system according to the invention, wherein a transfer chamber is included installed in a vessel designed to contain molten metal.
Figure 2:
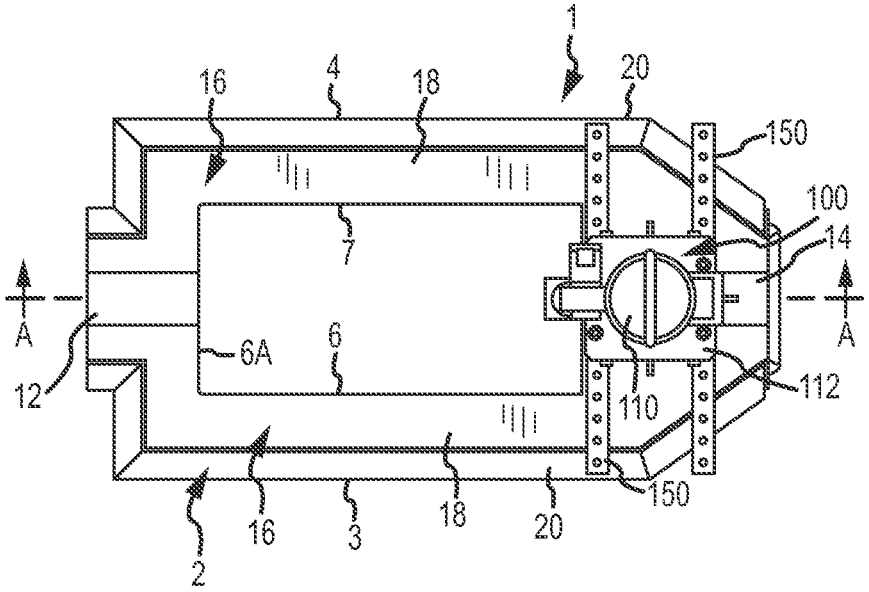
FIG. 2 is a top view of the system according to FIG. 1.
Figure 3:
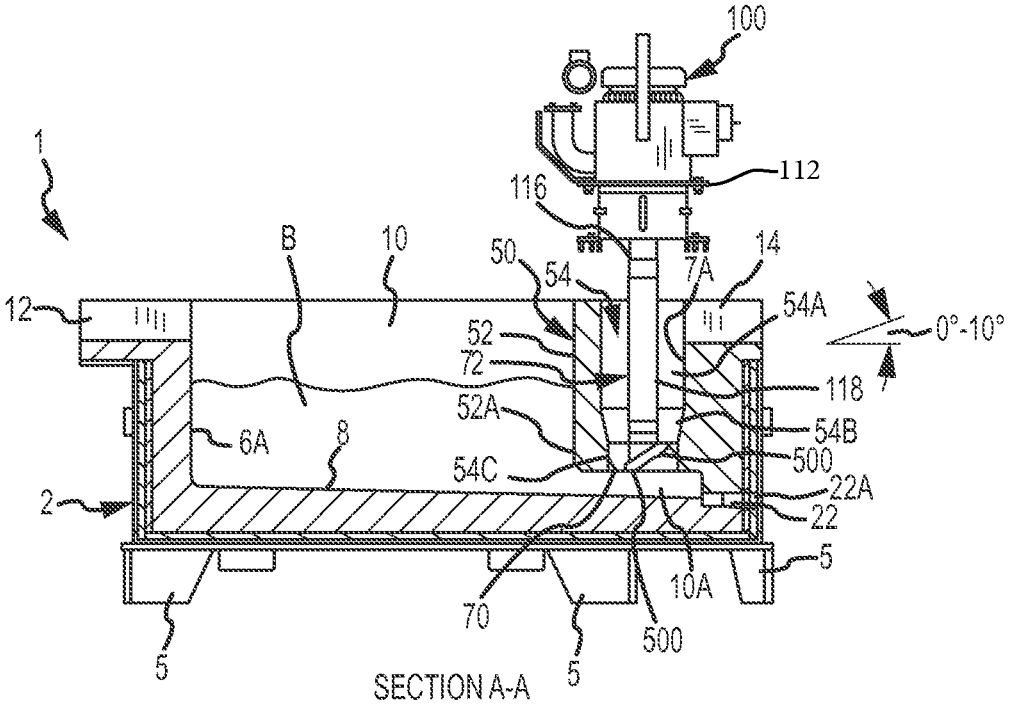
FIG. 3 is a side, partial cross-sectional view of the system of FIG. 1.
Figure 6:
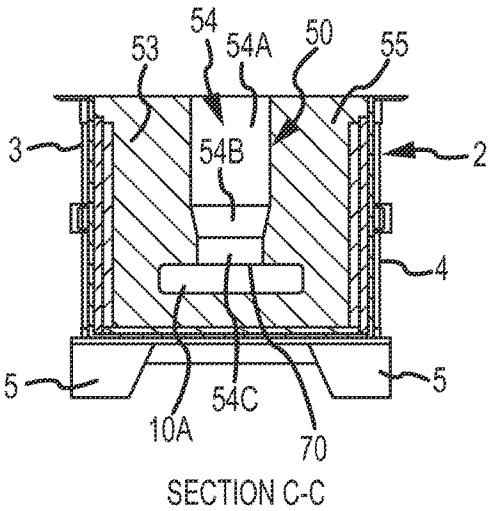
FIG. 6 is a cross-sectional view of the system of FIG. 4 taken along line C-C.
Figure 4:
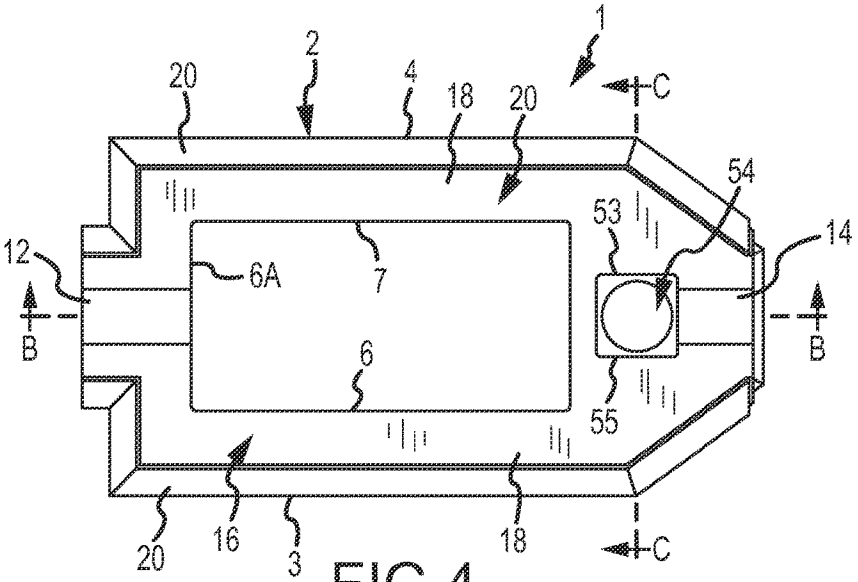
FIG. 4 is a top view of the system of FIG. 1 with the pump removed.
Figure 5:
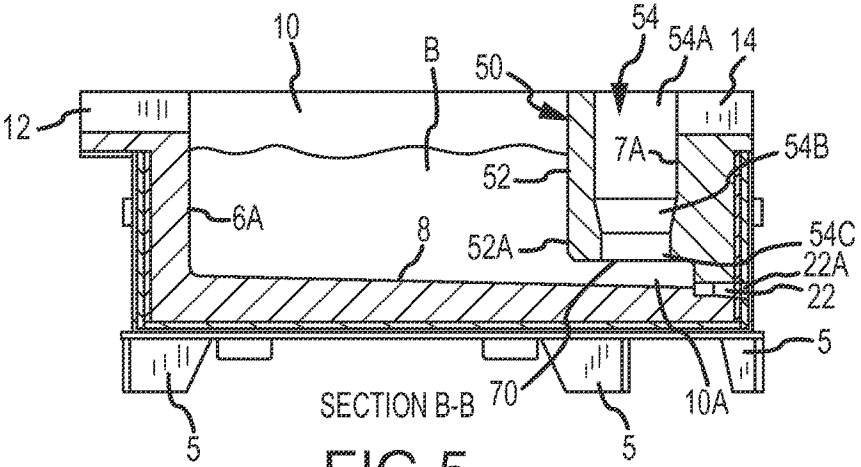
FIG. 5 is a side, partial cross-sectional view of the system of FIG. 4 taken along line B-B.
Figure 7:
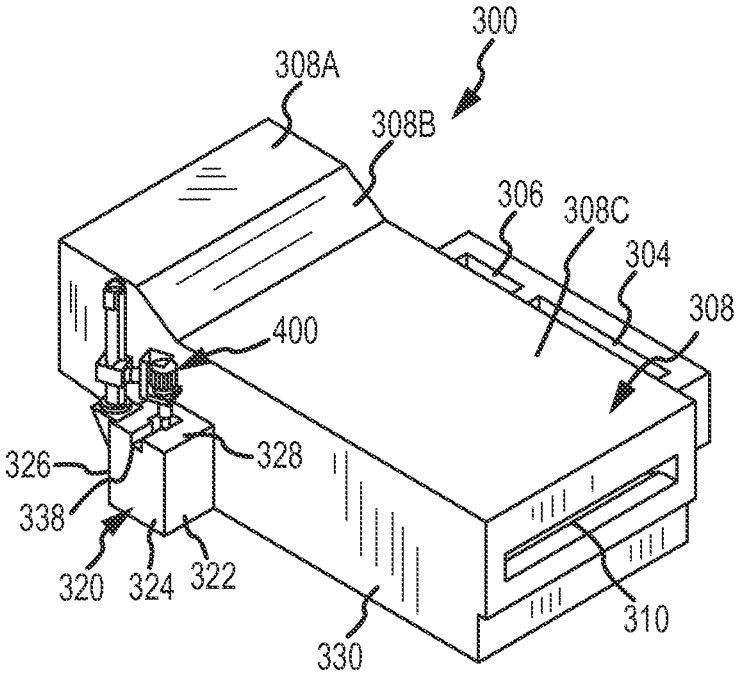
FIG. 7 is a top, perspective view of another system in accordance with the invention.
Figure 8:
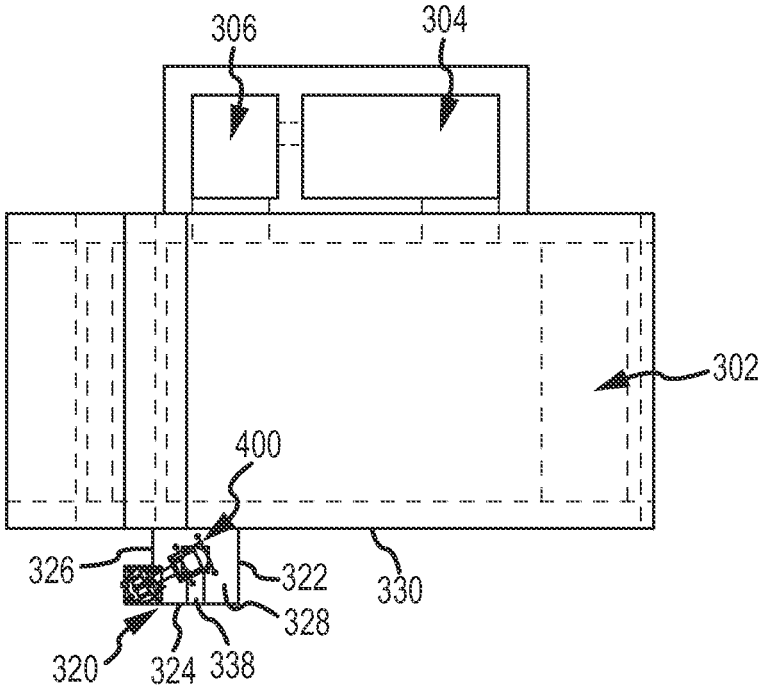
FIG. 8 is a top view of the system of FIG. 7 attached to or formed as part of a reverbatory furnace.
Figure 9:
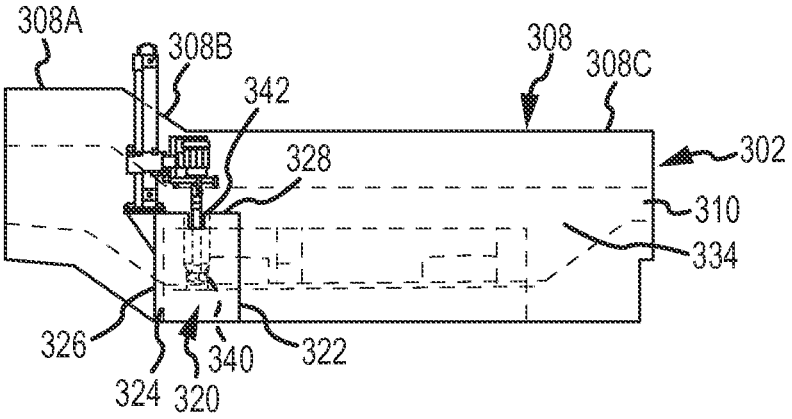
FIG. 9 is a partial, cross-sectional view of the system of FIG. 8.
Figure 11:
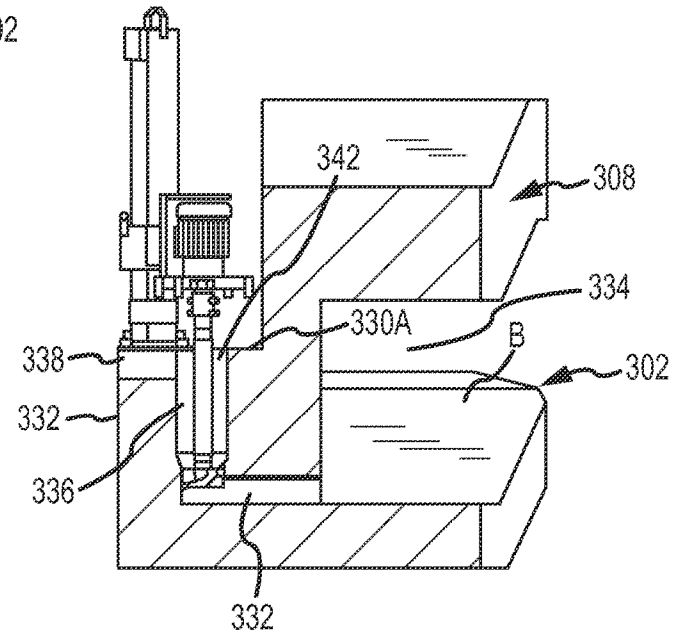
FIG. 11 is a partial, cross-sectional view of the system of FIG. 10 taken along line A-A.
Figure 10:
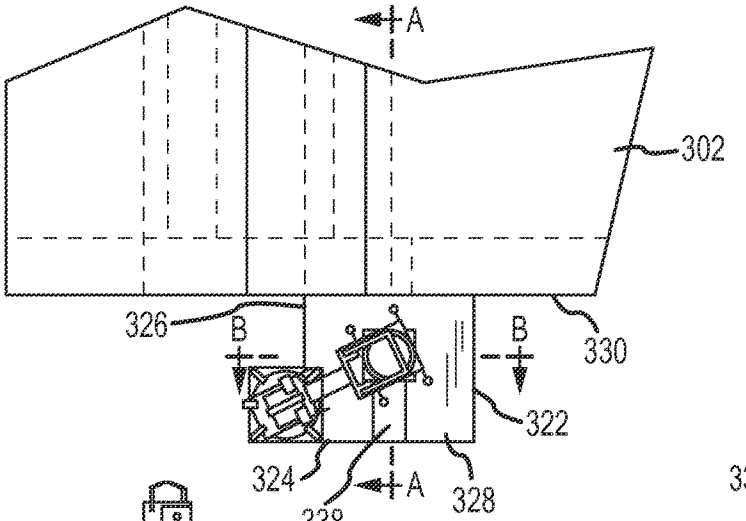
FIG. 10 is a top view of an alternate system according to the invention.
Figure 12:
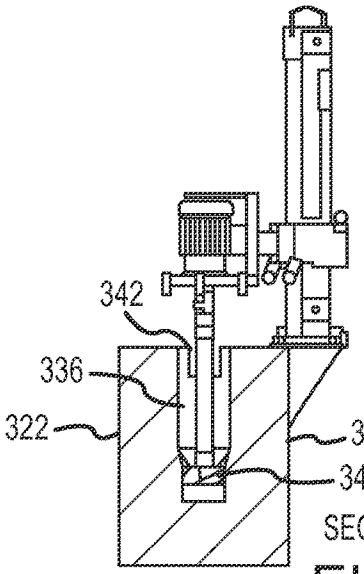
FIG. 12 is a partial, cross-sectional view of the system of FIG. 10 taken along line B-B.
Figure 13:
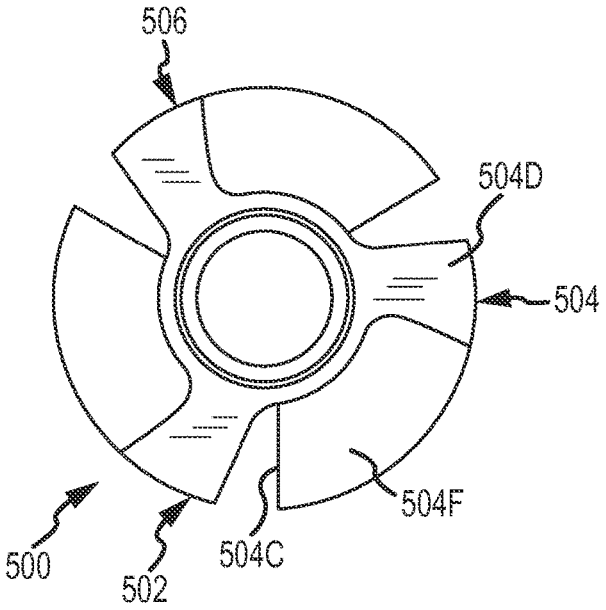
FIG. 13 is a top view of a rotor according to the invention.
Figure 14:
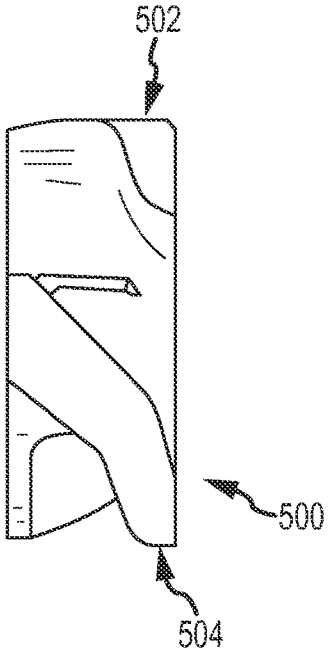
FIGS. 14 and 15 are side views of the rotor of FIG. 13.
Figure 15:
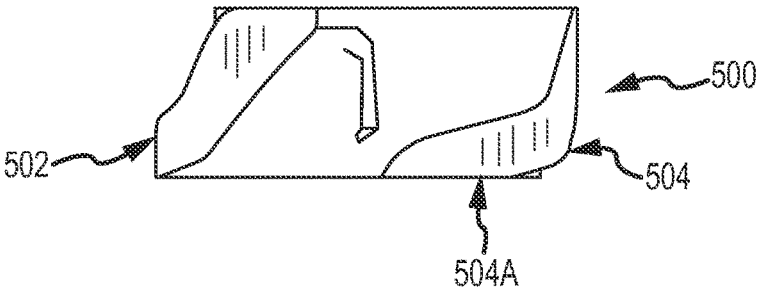
Figure 16:
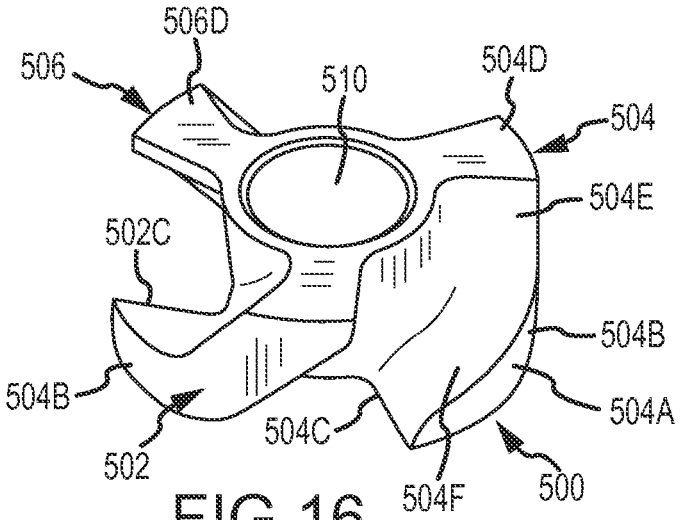
FIGS. 16 and 17 are top, perspective views of the rotor of FIG. 13 at different, respective positions of the rotor.
Figure 17:
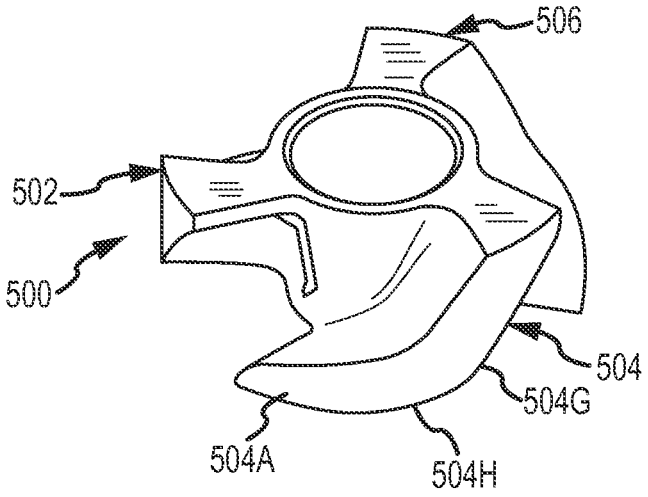
Figure 19:
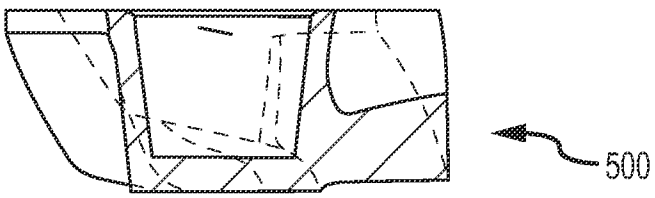
FIG. 19 is a cross-sectional view of the rotor of FIG. 18 taken along line A-A.
Figure 18:
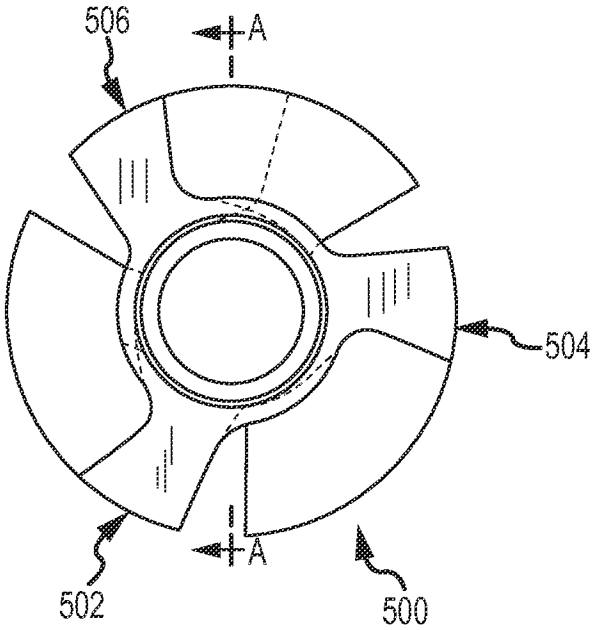
FIG. 18 is a top view of the rotor of FIG. 13.

Turning now to the drawings, where the purpose is to describe a preferred embodiment of the invention and not to limit same, systems and devices according to the invention will be described.

The invention includes a transfer chamber used with a vessel for the purpose of transferring molten metal out of the vessel in a controlled fashion using a pump, rather than relying upon gravity. It also is more preferred than using a transfer pump having a standard riser tube (such as the transfer pumps disclosed in the Background section) because, among other things, the use of such pumps create turbulence that creates dross and the riser tube can become plugged with solid metal.

FIGS. 1-6 show one preferred embodiment of the invention. A system 1 comprises a vessel 2, a transfer chamber 50 and a pump 100. Vessel 2 can be any vessel that holds molten metal (depicted as molten metal bath B), and as shown in this embodiment is an intermediary holding vessel. Vessel 2 has a first wall 3 and a second, opposite wall 4. Vessel 2 has support legs 5, inner side walls 6 and 7, inner end walls 6A and 7A, and an inner bottom surface 8. Vessel 2 further includes a cavity 10 that may be open at the top, as shown, or covered. An inlet 12 allows molten metal to flow into the cavity 10 and molten metal flows out of the cavity 10 through outlet 14. At the top 16 of vessel 2, there are flat surfaces 18 that preferably have metal flanges 20 attached. A tap-out port 22 is positioned lower than inner bottom surface 8 and has a plug 22A that can be removed to permit molten metal to exit tap-out port 22. As shown, inner bottom surface 8 is angled downwards from inlet 12 to outlet 14, although it need not be angled in this manner.

A transfer chamber according to the invention is most preferably comprised of a high temperature, castable cement, with a high silicon carbide content, such as ones manufactured by AP Green or Harbison Walker, each of which are part of ANH Refractory, based at 400 Fairway Drive, Moon Township, Pa. 15108, or Allied Materials. The cement is of a type know by those skilled in the art, and is cast in a conventional manner known to those skilled in the art.

Transfer chamber 50 in this embodiment is formed with and includes end wall 7A of vessel 2, although it could be a separate structure built outside of vessel 2 and positioned into vessel 2. Wall 7A is made in suitable manner. It is made of refractory and can be made using wooden forms lined with Styrofoam and then pouring the uncured refractory (which is a type of concrete known to those skilled in the art) into the mold. The mold is then removed to leave the wall 7A. If Styrofoam remains attached to the wall, it will burn away when exposed to molten metal.

Transfer chamber 50 includes walls 7A, 52, 53 and 55, which define an enclosed, cylindrical (in this embodiment) portion 54 that is sometimes referred to herein as an uptake section. Uptake section 54 has a first section 54A, a narrower third section 54B beneath section 54A, and an even narrower second section 54C beneath section 54B. An opening 70 is in communication with area 10A of cavity 10 of vessel 2.

Pump 100 includes a motor 110 that is positioned on a platform or superstructure 112. A drive shaft 114 connects motor 110 to rotor 500. In this embodiment, drive shaft 114 includes a motor shaft (not shown) connected to a coupling 116 that is also connected to a rotor drive shaft 118. Rotor drive shaft 118 is connected to rotor 500, preferably by being threaded into a bore at the top of rotor 500 (which is described in more detail below).

Pump 100 is supported in this embodiment by a brackets, or support legs 150. Preferably, each support leg 150 is attached by any suitable fastener to superstructure 112 and to sides 3 and 4 of vessel 2, preferably by using fasteners that attach to flange 20. It is preferred that if brackets or metal structures of any type are attached to a piece of refractory material used in any embodiment of the invention, that bosses be placed at the proper positions in the refractory when the refractory piece is cast. Fasteners, such as bolts, are then received in the bosses.

Rotor 500 is positioned in uptake section 54 preferably so there is a clearance of ¼ or less between the outer perimeter of rotor 500 and the wall of uptake section 54. As shown, rotor 500 is positioned in the lowermost second section 54C of uptake section 54 and its bottom surface is approximately flush with opening 70. Rotor 500 could be located anywhere where it would push molten metal from area 10A upward into uptake section 54 with enough pressure for the molten metal to reach and pass through outlet 14, thereby exiting vessel 2. For example, rotor 500 could only partially located in uptake section 54 (with part of rotor 500 in area 10A, or rotor 500 could be positioned higher in uptake section 54, as long as it fit sufficiently to generate adequate pressure to move molten metal into outlet 14.

Another embodiment of the invention is system 300 shown in FIGS. 7-12. In this embodiment a transfer chamber 320 is positioned adjacent a vessel, such as a reverbatory furnace 301, for retaining molten metal.

System 300 includes a reverbatory furnace 302, a charging well 304 and a well 306 for housing a circulation pump. In this embodiment, the reverbatory furnace 302 has a top covering 308 that includes three surfaces: first surface 308A, second, angled surface 308B and a third surface 308C that is lower than surface 308A and connected to surface 308A by surface 308B. The purpose of the top surface 308 is to retain the heat of molten metal bath B.

An opening 310 extends from reverbatory furnace 302 and is a main opening for adding large objects to the furnace or draining the furnace.

Transfer well 320, in this embodiment, has three side walls 322, 324 and 326, and a top surface 328. Transfer well 320 in this embodiment shares a common wall 330 with furnace 302, although wall 330 is modified to create the interior of the transfer well 320. Turning now to the inside structure of the transfer well 320, it includes an intake section 332 that is in communication with a cavity 334 of reverbatory furnace 302. Cavity 334 includes molten metal bath B when system 300 is in use, and the molten metal can flow through intake section 332 into transfer well 320.

Intake section 332 leads to an enclosed section 336 that leads to an outlet 338 through which molten metal can exit transfer well 320 and move to another structure or vessel. Enclosed section 336 is preferably square, and fully enclosed except for an opening 340 at the bottom, which communicates with intake section 332 and an opening 342 at the top of enclosed section 336, which is above and partially includes the opening that forms outlet 338.

In order to help form the interior structure of well 320, wall 330 has an extended portion 330A that forms part of the interior surface of intake section 332. In this embodiment, opening 340 has a diameter, and a cross sectional area, smaller than the portion of enclosed section 336 above it. The cross-sectional area of enclosed section 336 may remain constant throughout, may gradually narrow to a smaller cross-sectional area at opening 340, or there may be one or more intermediate portions of enclosed section 336 of varying diameters and/or cross-sectional areas.

A pump 400 has the same preferred structure as previously described pump 100. Pump 400 has a motor 402, a superstructure 404 that supports motor 402, and a drive shaft 406 that includes a motor drive shaft 408 and a rotor drive shaft 410. A rotor 500 is positioned in enclosed section 336, preferably approximately flush with opening 340. Where rotor 500 is positioned it is preferably ¼" or less; or ⅛" or less, smaller in diameter than the inner diameter of the enclosed section 336 in which it is positioned in order to create enough pressure to move molten metal upwards.

A preferred rotor 500 is shown in FIGS. 13-19. Rotor 500 is designed to push molten metal upward into enclosed section 336. The preferred rotor 500 has three identically formed blades 502, 504 and 506. Therefore, only one blade shall be described in detail. It will be recognized, however, that any suitable number of blades could be used or that another structure that pushes molten metal up the enclosed section could be utilized.

Blade 504 has a multi-stage blade section 504A that includes a face 504F. Face 504F is multi-faceted and includes portions that work together to move molten metal upward into the uptake section.

A system according to the invention may also utilize a standard molten metal pump, such as a circulation or gas-release (also called a gas-injection) pump 100 Pump 100 is preferably any type of circulation or gas-release pump. The structure of circulation and gas-release pumps is known to those skilled in the art and one preferred pump for use with the invention is called "The Mini," manufactured by Molten Metal Equipment Innovations, Inc. of Middlefield, Ohio 44062, although any suitable pump may be used. The pump 100 preferably has a superstructure 112, a drive source 110 (which is most preferably an electric motor) mounted on the superstructure 112, support posts (not shown), a drive shaft 72, and a pump base not shown. The support posts connect the superstructure 112 to a base 30 in order to support the superstructure 112.

Drive shaft 72 preferably includes a motor drive shaft (not shown) that extends downward from the motor and that is preferably comprised of steel, a rotor drive shaft 118, that is preferably comprised of graphite, or graphite coated with a ceramic, and a coupling (not shown) that connects the motor drive shaft to end 116 of rotor drive shaft 32.

The pump base includes an inlet (not shown) at the top and/or bottom of the pump base, wherein the inlet is an opening that leads to a pump chamber (not shown), which is a cavity formed in the pump base. The pump chamber is connected to a tangential discharge, which is known in art, that leads to an outlet, which is an opening in the side wall (not shown) of the pump base. In the preferred embodiment, the side wall of the pump base including the outlet has an extension (not shown) formed therein and the outlet is at the end of the extension.

In operation, the motor rotates the drive shaft, which rotates the rotor. As the rotor (also called an impeller) rotates, it moves molten metal out of the pump chamber, through the discharge and through the outlet.

A circulation or transfer pump may be used to simply move molten metal in a vessel towards a transfer chamber according to the invention where the pump inside of the transfer chamber moves the molten metal up and into the outlet.

Figure 20:
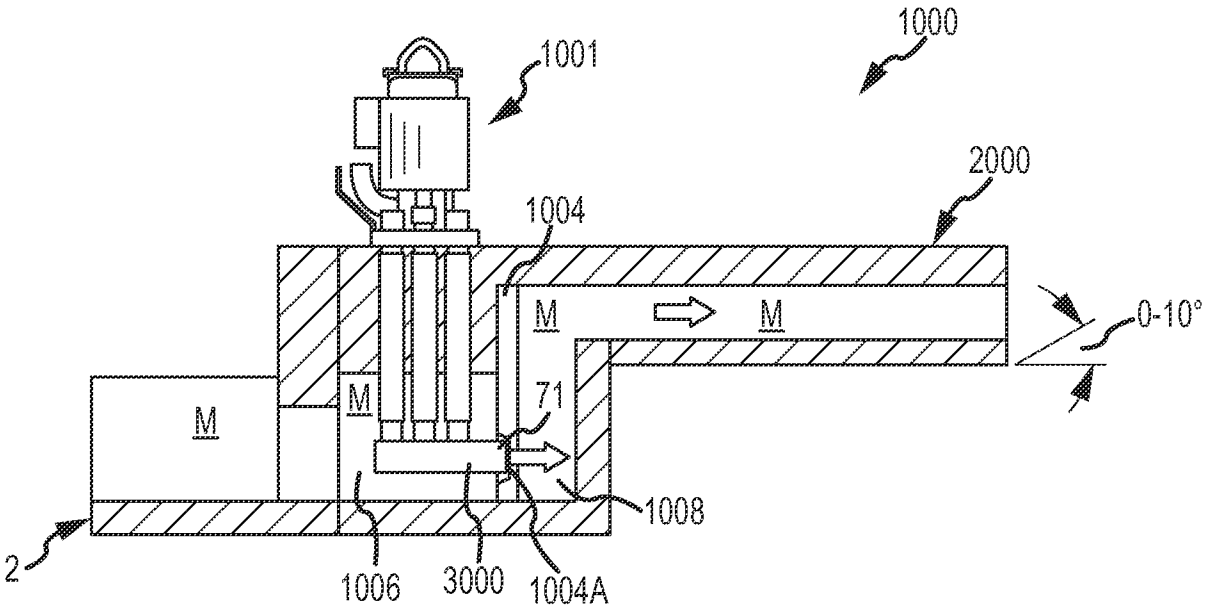
FIG. 20 is a side, partial cross-sectional view of an alternate embodiment of the invention.
Figure 21:
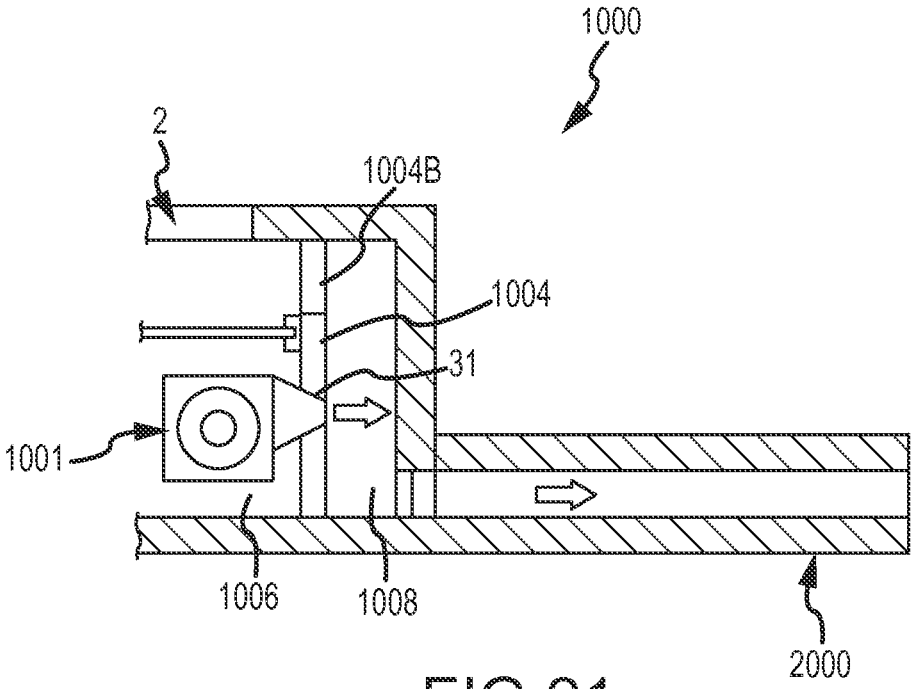
FIG. 21 is a top, partial cross-sectional view of the embodiment of FIG. 20.
Figure 22:
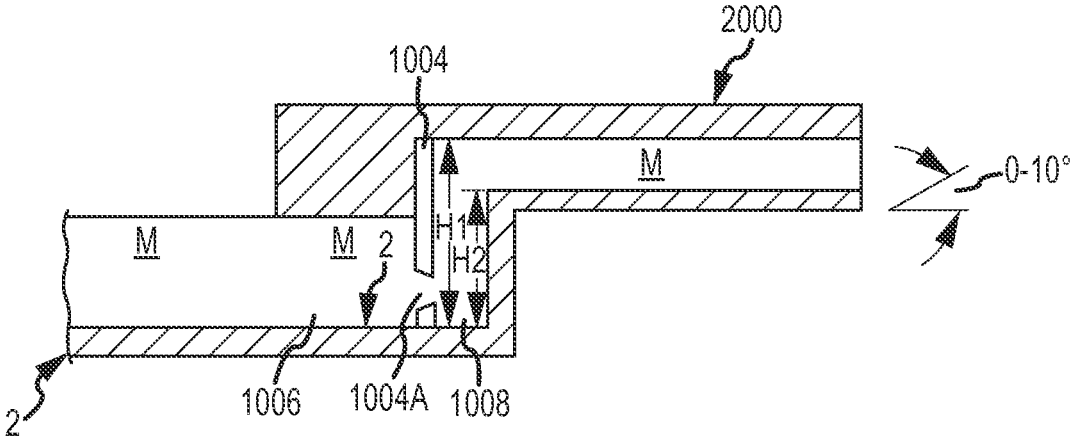
FIG. 22 is a partial, cross-sectional side view showing the height relationship between components of the embodiment of FIGS. 20-21.

Alternatively, a circulation or gas-transfer pump 1001 may be used to drive molten metal out of vessel 2. As shown in FIGS. 20-22, a system 1000 as an example, has a dividing wall 1004 that would separate vessel 2 into at least two chambers, a first chamber 1006 and a second chamber 1008, and any suitable structure for this purpose may be used as dividing wall 1004. As shown in this embodiment, dividing wall 1004 has an opening 1004A and an optional overflow spillway 1004B, which is a notch or cut out in the upper edge of dividing wall 1004. Overflow spillway 1004B is any structure suitable to allow molten metal (designated as M) to flow from second chamber 1008, past dividing wall 1004, and into first chamber 1006 and, if used, overflow spillway 1004B may be positioned at any suitable location on wall 1004. The purpose of optional overflow spillway 1004B is to prevent molten metal from overflowing the second chamber 1008, by allowing molten metal in second chamber 1008 to flow back into first chamber 1006 or vessel 2 or other vessel used with the invention.

At least part of dividing wall 1004 has a height H1, which is the height at which, if exceeded by molten metal in second chamber 1008, molten metal flows past the portion of dividing wall 1004 at height H1 and back into first chamber 1006 of vessel 2. Overflow spillway 1004B has a height H1 and the rest of dividing wall 1004 has a height greater than H1. Alternatively, dividing wall 1004 may not have an overflow spillway, in which case all of dividing wall 1004 could have a height H1, or dividing wall 1004 may have an opening with a lower edge positioned at height H1, in which case molten metal could flow through the opening if the level of molten metal in second chamber 1008 exceeded H1. H1 should exceed the highest level of molten metal in first chamber 1006 during normal operation.

Second chamber 1008 has a portion 1008A, which has a height H2, wherein H2 is less than H1 (as can be best seen in FIG. 2A) so during normal operation molten metal pumped into second chamber 1008 flows past wall 1008A and out of second chamber 1008 rather than flowing back over dividing wall 1004 and into first chamber 1006.

Dividing wall 1004 may also have an opening 1004A that is located at a depth such that opening 1004A is submerged within the molten metal during normal usage, and opening 1004A is preferably near or at the bottom of dividing wall 1004. Opening 1004A preferably has an area of between 6 in.$^2$ and 24 in.$^2$, but could be any suitable size.

Dividing wall 1004 may also include more than one opening between first chamber 1006 and second chamber 1008 and opening 1004A (or the more than one opening) could be positioned at any suitable location(s) in dividing wall 1004 and be of any size(s) or shape(s) to enable molten metal to pass from first chamber 1006 into second chamber 1008.

Optional launder 2000 (or any launder according to the invention) is any structure or device for transferring molten metal from a vessel such as vessel 2 or 302 to one or more structures, such as one or more ladles, molds (such as ingot molds) or other structures in which the molten metal is ultimately cast into a usable form, such as an ingot. Launder 2000 may be either an open or enclosed channel, trough or conduit and may be of any suitable dimension or length, such as one to four feet long, or as much as 100 feet long or longer. Launder 2000 may be completely horizontal or may slope gently upward, back towards the vessel. Launder 2000 may have one or more taps (not shown), i.e., small openings stopped by removable plugs. Each tap, when unstopped, allows molten metal to flow through the tap into a ladle, ingot mold, or other structure. Launder 2000 may additionally or alternatively be serviced by robots or cast machines capable of removing molten metal M from launder 20.

It is also preferred that the pump 1001 be positioned such that extension 31 of base 3000 is received in the first opening 1004A. This can be accomplished by simply positioning the pump 1001 in the proper position. Further the pump may be held in position by a bracket or clamp that holds the pump against the dividing wall 1004, and any suitable device may be used. For example, a piece of angle iron with holes formed in it may be aligned with a piece of angle iron with holes in it on the dividing wall 1004, and bolts could be placed through the holes to maintain the position of the pump 1001 relative the dividing wall 1004.

In operation, when the motor is activated, molten metal is pumped out of the outlet through first opening 1004A, and into chamber 1008. Chamber 1008 fills with molten metal until it moves out of the vessel 2 through the outlet. At that point, the molten metal may enter a launder or another vessel.

If the molten metal enters a launder, the launder preferably has a horizontal angle of 0° or is angled back towards chamber 1008 of the vessel 2. The purpose of using a launder with a 0° slope or that is angled back towards the vessel is because, as molten metal flows through the launder, the surface of the molten metal exposed to the air oxidizes and dross is formed on the surface, usually in the form of a semi-solid or solid skin on the surface of the molten metal. If the launder slopes downward it allows gravity to influence the flow of molten metal, and tends to pull the dross or skin with the flow. Thus, the dross, which includes contaminants, is included in downstream vessels and adds contaminants to finished products.

It has been discovered that if the launder is at a 0° or horizontal angle tilting back towards the vessel, the dross remains as a skin on the surface of the molten metal and is not pulled into downstream vessels to contaminate the molten metal inside of them. The preferred horizontal angle of any launder connected to a vessel according to aspects of the invention is one that is at 0° or slopes (or tilts) back towards the vessel, and is between 0° and 10°, or 0° and 5°, or 0° and 3°, or 1° and 3°, or a backward slope of about ⅛" for every 10' of launder length.

Turning now to FIGS. 23-26, an alternate embodiment of aspects of the invention is shown. System 2000 is similar to the previously described systems in that the pump 2010 maintains a constant flow of molten metal out of vessel 2002 regardless of the level of molten metal in vessel 2002 and regardless of the flow rate of molten metal into vessel 2002 (unless the level becomes so low that the molten metal can no longer be pumped).

As shown herein, vessel 2002 is constructed differently than vessel 2, but vessel 2 could also be used to degas metal in the manner described herein with the same pumping structures described previously.

System 2000 is for degassing molten metal. In additional to pump 2010, system 2000 preferably includes one or more degassers 2020. The degassers 2020 are rotary degassers and can be of any suitable design and size for system 2000. Generally, each of the rotary degassers 2020 has a motor 2022, a shaft 2024 that connects the motor 2022 to a rotor, and a rotor 2026. As is known in the art, gas passes through shaft 2024 and is released through or under rotor 2026. As shown, system 2000 has three rotary degassers 2020 in line with the path of molten metal flow through vessel 2002.

System 2000 also may include one or more immersion heaters to keep the molten metal at a desired temperature and such heaters are known in the art. In the embodiment shown, there is an immersion heater 2040 between two of the degassers 2020 and another immersion heater between a third rotary degasser and the pump 2010. Any appropriate number of immersion heaters, however, may be used, or none may be used.

Turning now to vessel 2002, it is supported by legs 2004, has sides 2006, 2008, and ends 2050, 2052. Vessel 2002 its preferably comprised of suitable refractory material, the compositions and method of manufacture of same being known to those skilled in the art. Each end 2050 and 2052 has a tap-out plug 2054 having a launder-type exit 2056. Vessel 2002 as shown comprises two cemented vessel portions 2002A and 2002B. Vessel portion 2002A retains two rotary degassers 2020 and an immersion heater 2040, although it could hold only one degasser 2020 and no immersion heaters 2040, or no degassers 2020 or no immersion heater 2040. Further, if dimensioned differently, it could retain more degassers 2020 or immersion heaters 2040 than shown.

Vessel portion 2002A includes an inlet 2100 through which molten metal enters vessel 2002. Often the molten metal entering inlet 2100 ebbs and flows at different rates so the level of molten metal in vessel 2 can vary. Vessel portion 2002A has metal frame portions to assist in mounting structures to it and in it, and such frame structures are known to those skilled in the art.

Figure 24:
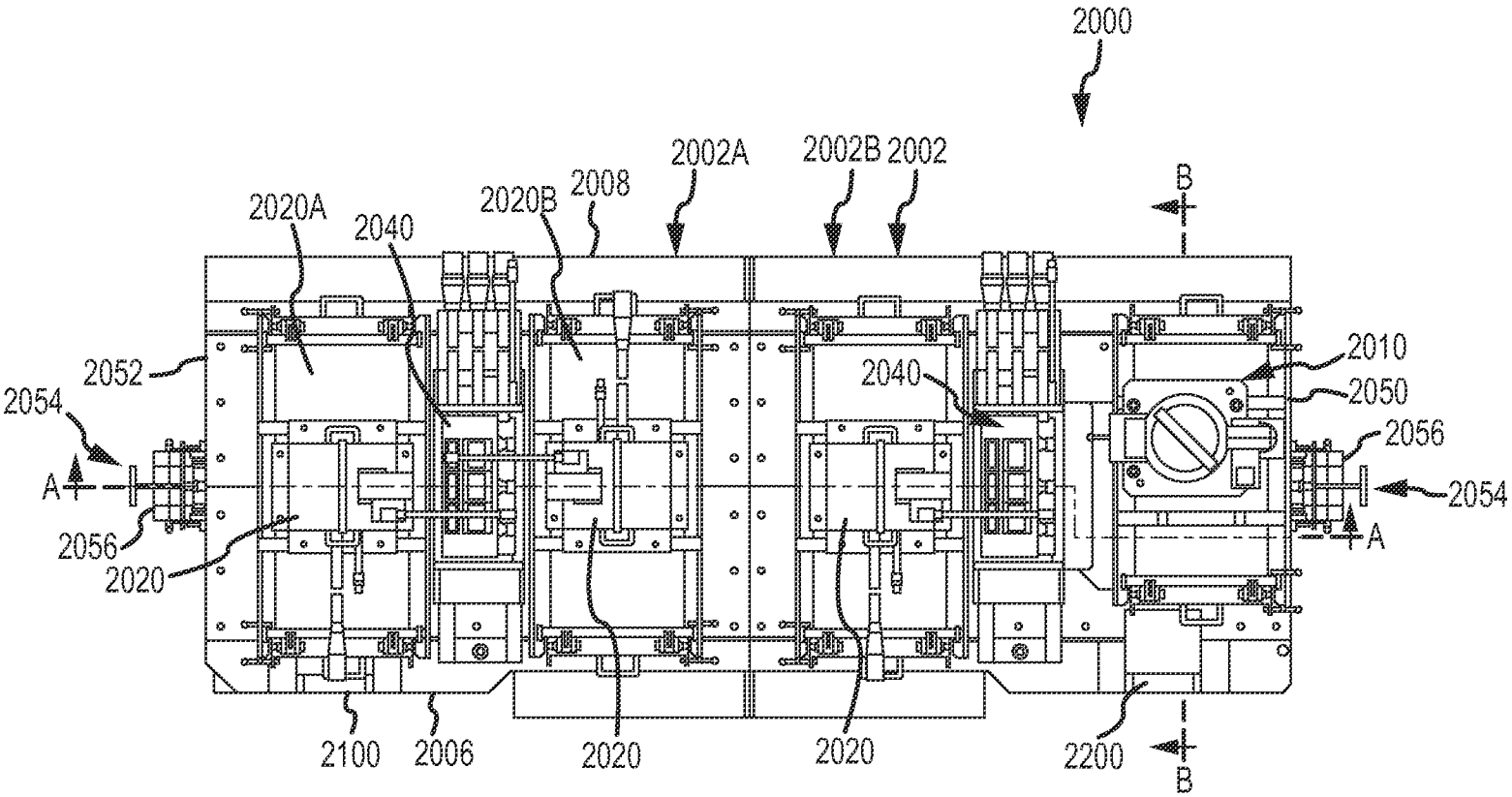
FIG. 24 is a top view of the embodiment of FIG. 23.
Figure 25:
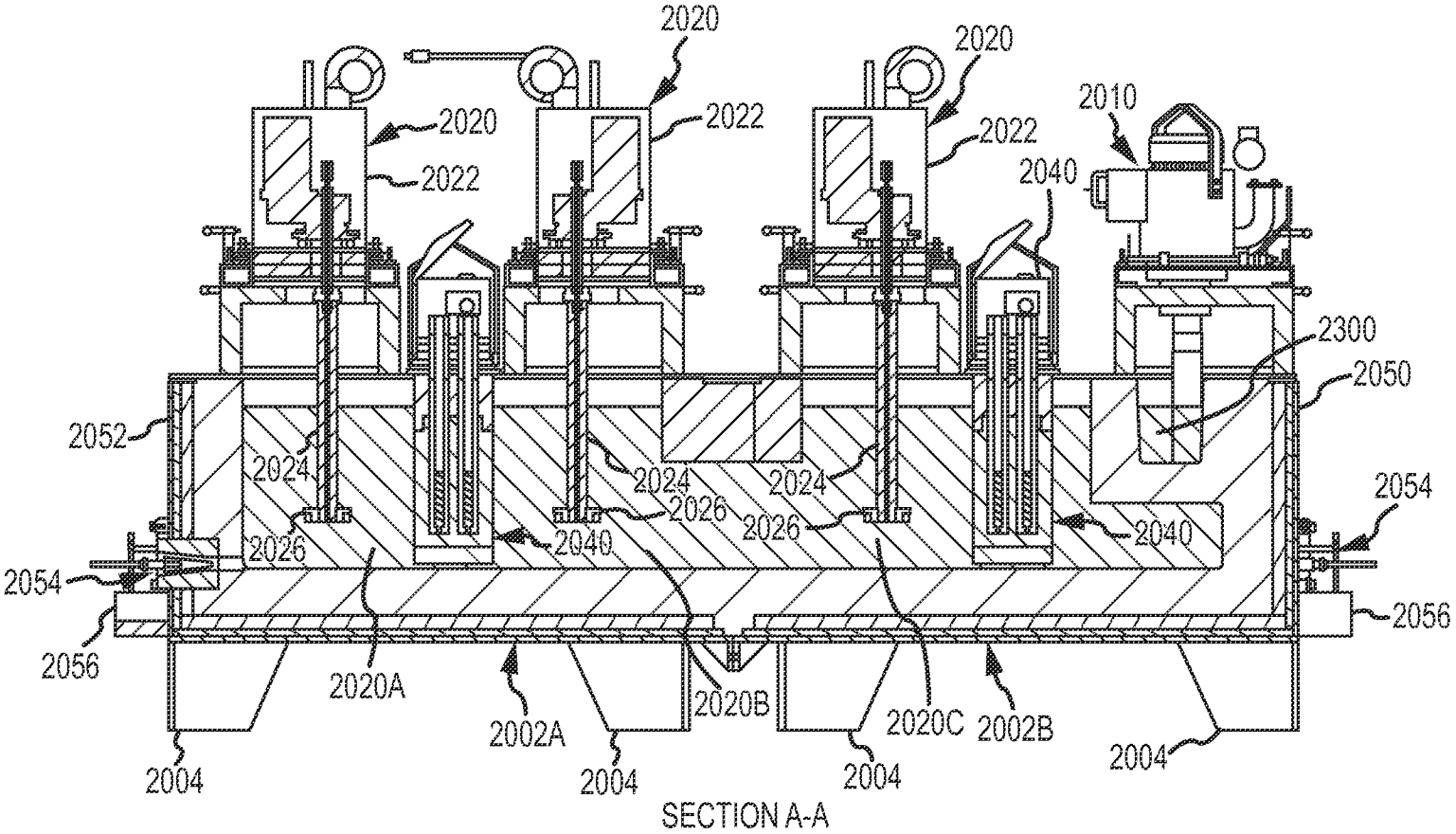
FIG. 25 is a cross-sectional, side view of the embodiment of FIG. 23.
Figure 26:
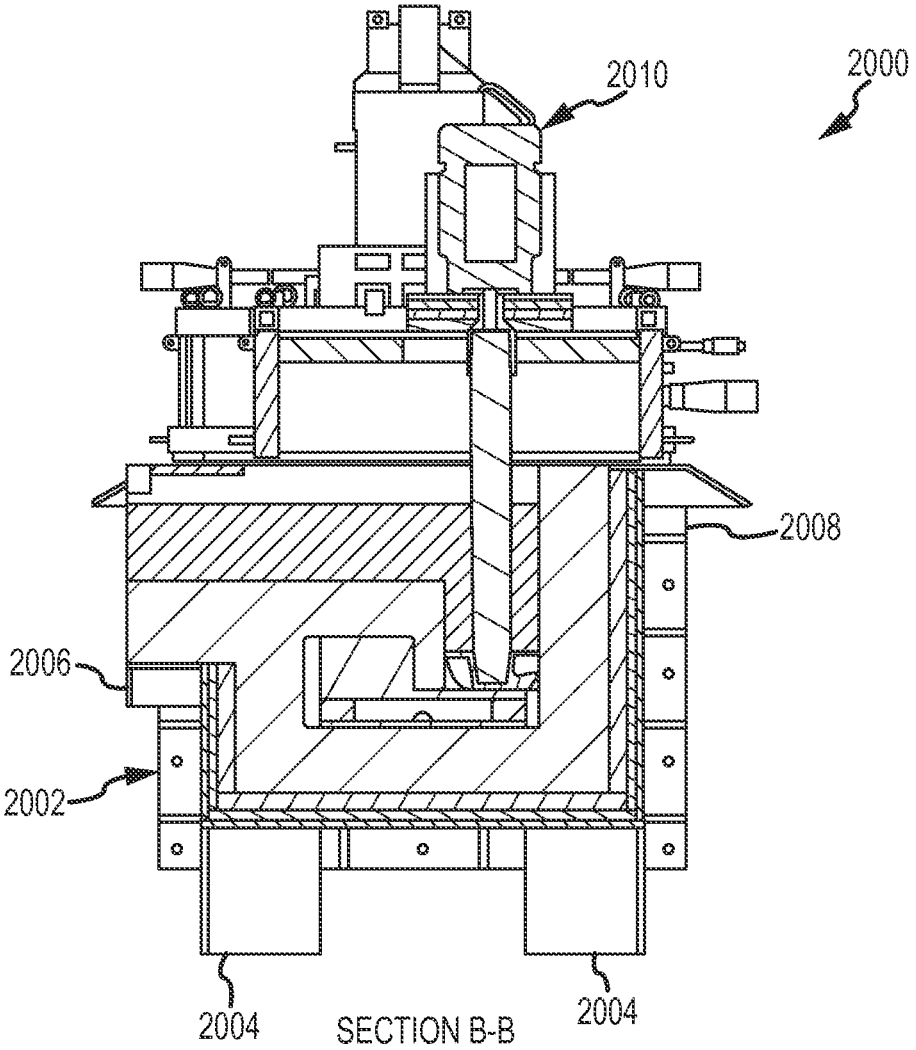
FIG. 26 is a cross-sectional, end view of one of the ends of the embodiment shown in FIG. 23.

Inside of vessel portion 2002A, as best seen in FIG. 24 are separate compartments for housing rotary degassers 2020. Compartment 2020A is separated from compartment 2020B by immersion heater 2040, with molten metal preferably passing under or around immersion heater 2040 to move from chamber 2020A to chamber 2020B. Alternatively, any other structure could be used to separate these rotary degassers 2020 or no structure could be used. The purpose of using immersion heater 2040 is to maintain the molten metal at a proper temperature because vessel 2002 has no heat source, and because dividing the vessel portion 2002A into two degassing chambers leads to better degassing because the molten metal is retained in a smaller space while being degassed.

As shown, section 2002B is connected to section 2002A and includes a rotary degasser 2020, an immersion heater 2040 downstream of the rotary degasser 2020, and a pump transfer chamber (also called a transfer chamber or transfer conduit) downstream of the immersion heater 2040. One or both of rotary degasser 2020 and immersion heater 2040 may not be included in section 2002B, although for the best results they are included.

Pump transfer chamber 2300 and pump 2010 are each preferably of the same respective structures described previously for transferring molten metal through an uptake section and out of the outlet 2200 in an relatively even, constant flow. Using such a structure, the flow of molten metal through vessel 2002, which begins at inlet 2100 and moves through compartments 2020A, 2020B and 2020C and then through the transfer chamber 2300 and out of outlet 2200, is relatively consistent regardless of the flow into inlet 2100 or the level of molten metal in vessel 2002 (unless it becomes so low that pump 2010 can no longer generate a proper flow). This because the flow is controlled by the pump 2010 instead of the amount of molten metal entering inlet 2100.

Alternatively, instead of the pump transfer chambers and pumps described above, the molten metal flow through chamber 2002 and out of outlet 2200 may be controlled by a pump structure as disclosed in Ser. No. 13/797,616, filed Mar. 12, 2013, by Paul V. Cooper, the disclosure of which is incorporated herein by reference.

Figure 28:
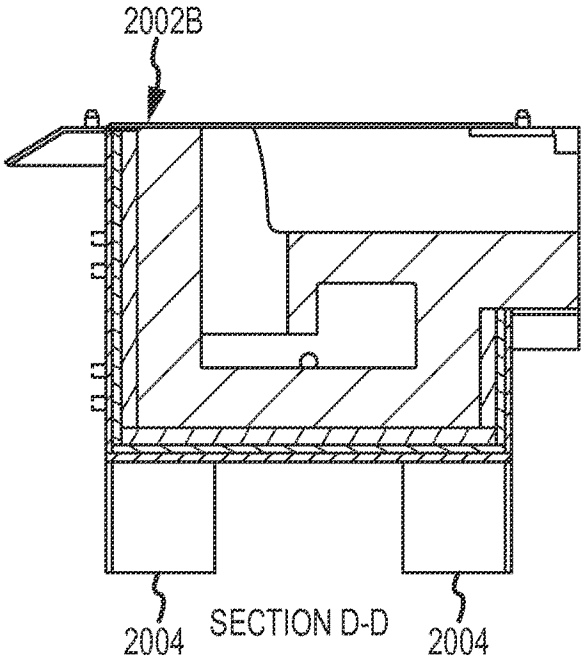
FIG. 28 is a cross-sectional view of the vessel portion of FIG. 27 taken along lines D-D.
Figure 27:
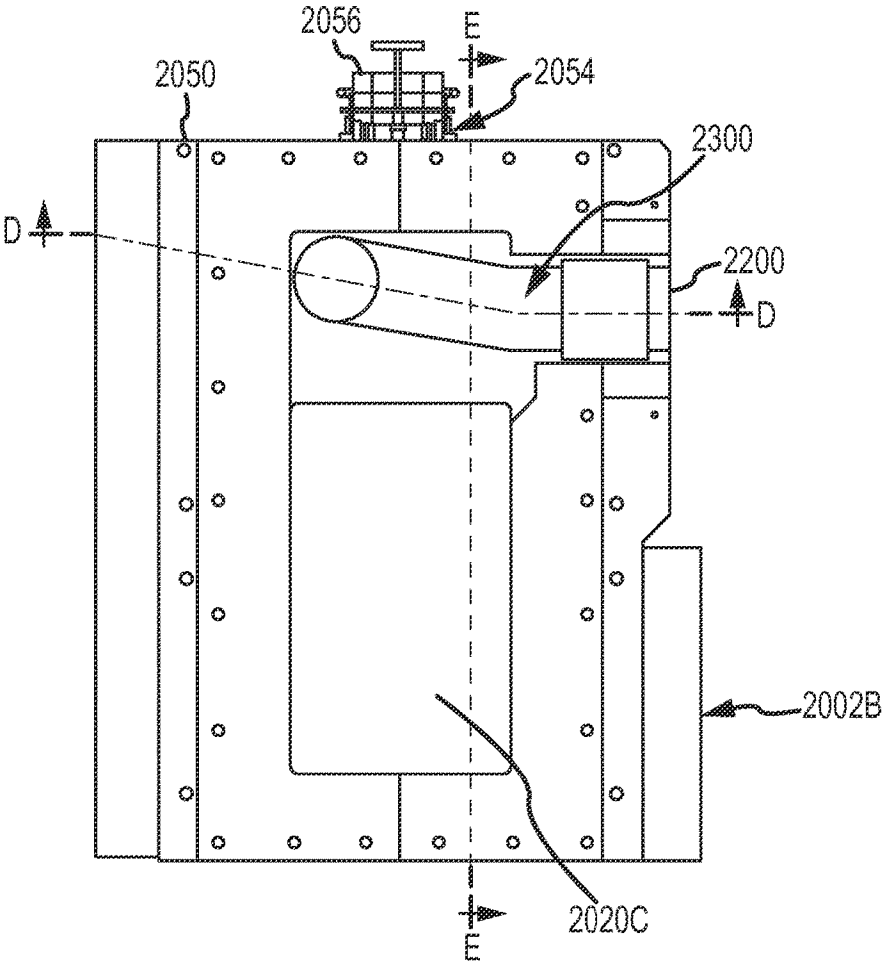
FIG. 27 is a top view of the vessel portion of FIG. 20 that receives an embodiment of a transfer pump according to the invention.
Figure 29:
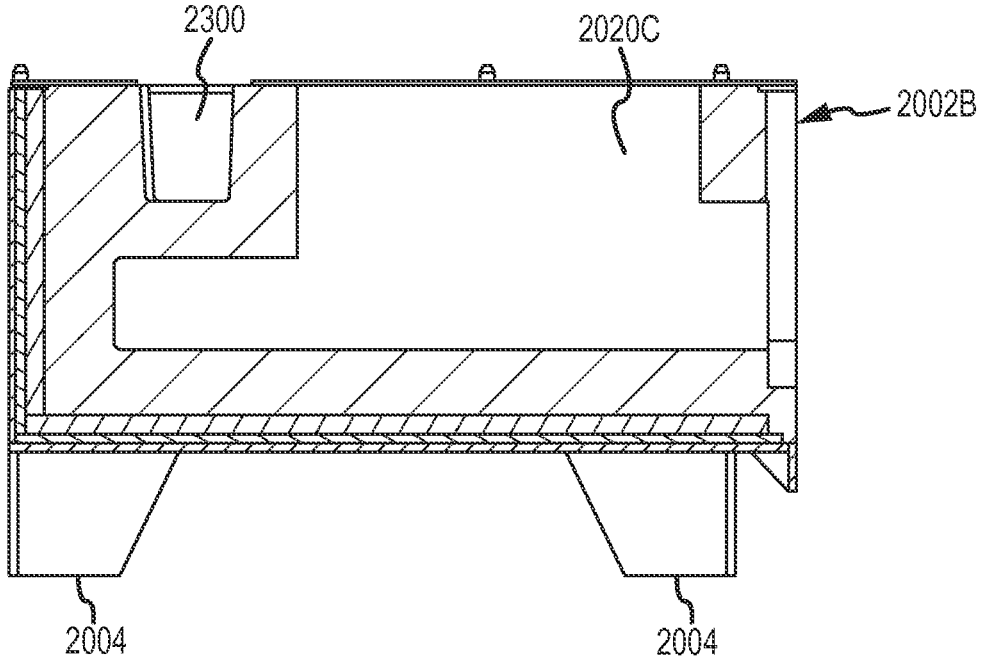
FIG. 29 is a cross-sectional view of the vessel portion of FIG. 27 taken along lines E-E.
Figure 31:
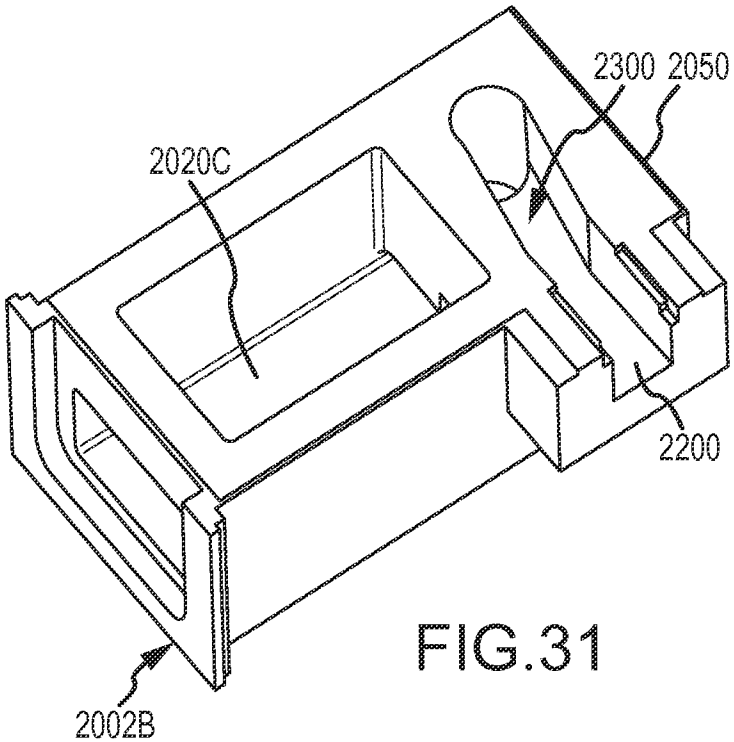
FIG. 31 is a front, perspective view of the refractory portion of the vessel portion of FIG. 27.
Figure 30:
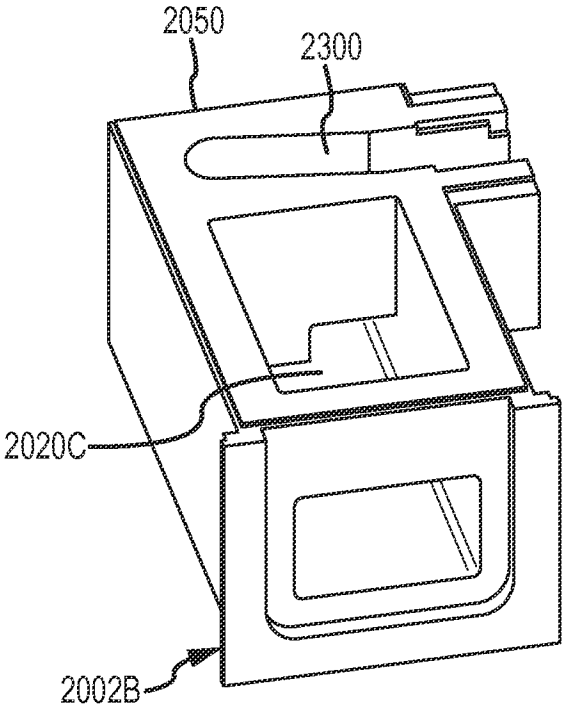
FIG. 30 is a side, perspective view of the refractory portion of the vessel portion of FIG. 27.

FIGS. 27-29 show views of section 2002B of vessel 2000 with the components removed. FIGS. 30 and 31 show views of the refractory portion of section 2002 with the components and metal framing removed.

Figure 23:
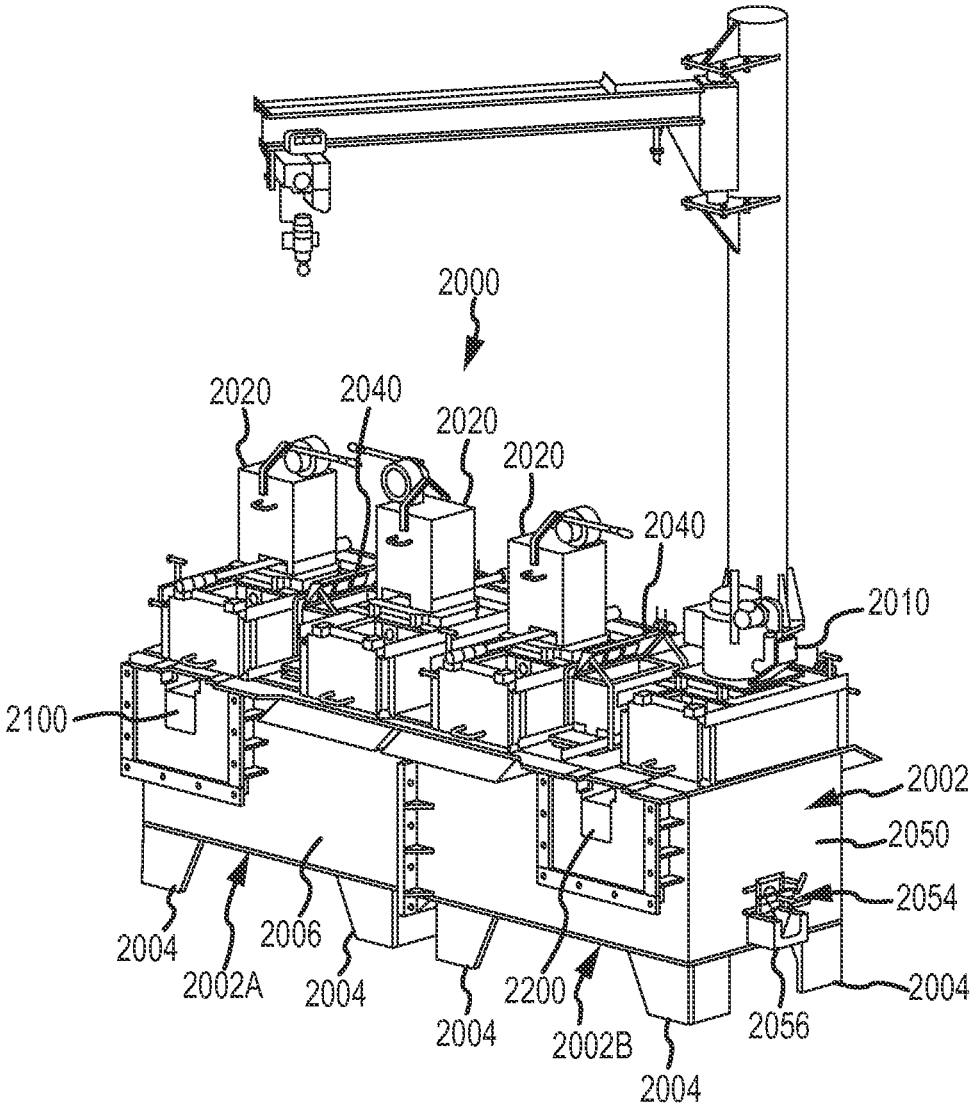
FIG. 23 is a front, perspective view of an alternate embodiment according to the invention.

In FIG. 23 of system 2000, a jib crane is shown, but this is merely a device for lifting and removing components from the vessel 2002 and is not part of the invention.

FIGS. 32-35 show an alternate system 3000 of the invention that utilizes the same rotary degassers, immersion heaters, pump structures, and transfer chamber structures as previously described with respect to system 2000 except that in this embodiment there is a one-piece vessel 3002, two rotary degassers 3020 with an immersion heater 3040 between them, and a pump 3010 with an immersion heater between it and the nearest degasser 3020.

In this embodiment, molten metal flows into vessel 3002 through inlet 3100, moves through chambers 3020A and 3020B and then enters the transfer chamber (or pump transfer chamber or transfer conduit) where it is pumped out of vessel 3002 through outlet 3200 by pump 3010 in a relatively even flow regardless of the rate of flow into inlet 3100 or the level of molten metal in vessel 3002 (unless the level becomes so low that pump 3100 cannot function properly).

Figure 32:
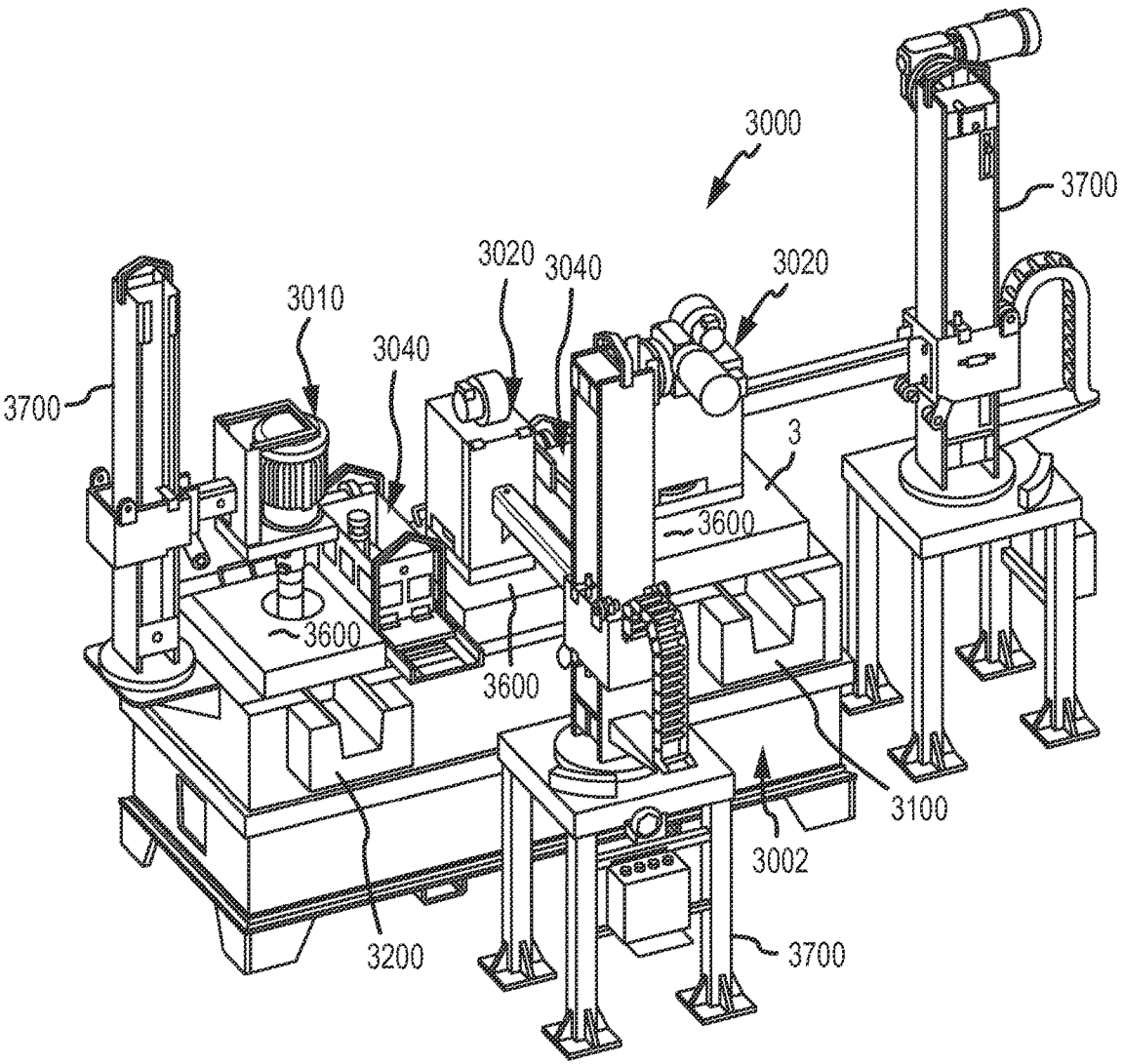
FIG. 32 is a front, perspective view of an alternate embodiment according to aspects of the invention.
Figure 33:
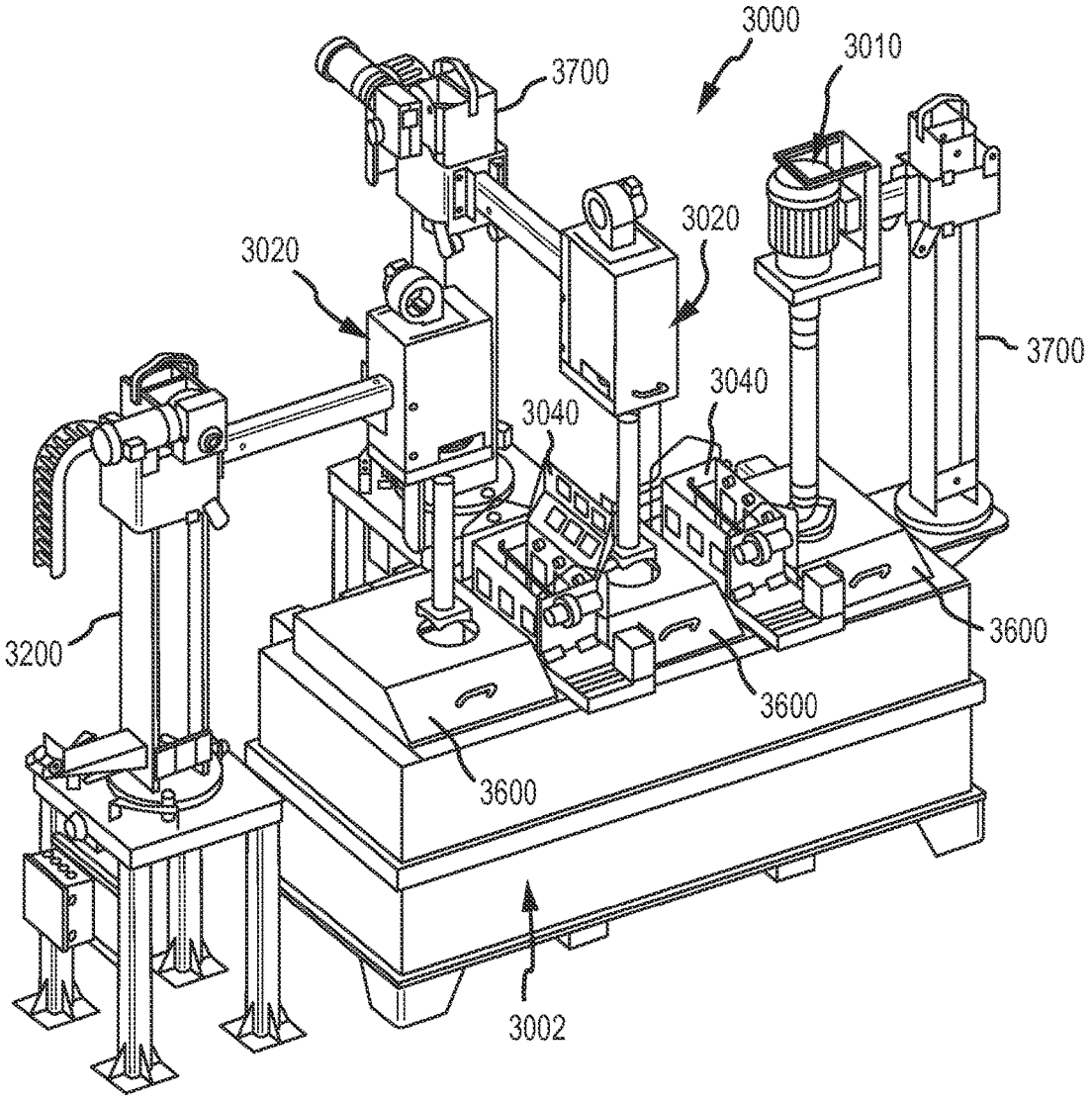
FIG. 33 is a rear, perspective view of the embodiment of FIG. 27 with the components in their raised positions.
Figure 34:
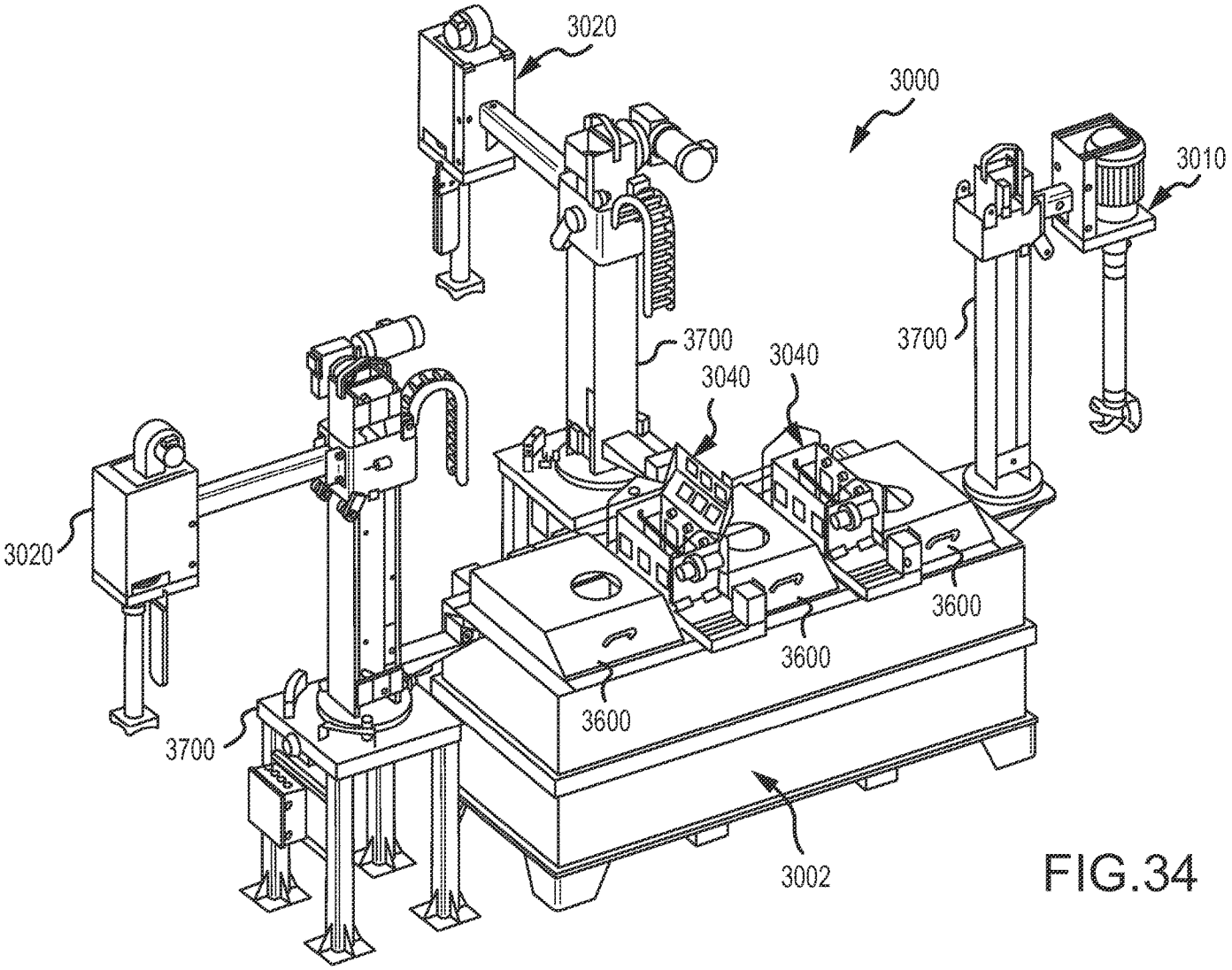
FIG. 34 is a rear, perspective view of the embodiment of FIG. 27 with the components removed for maintenance purposes.
Figure 35:
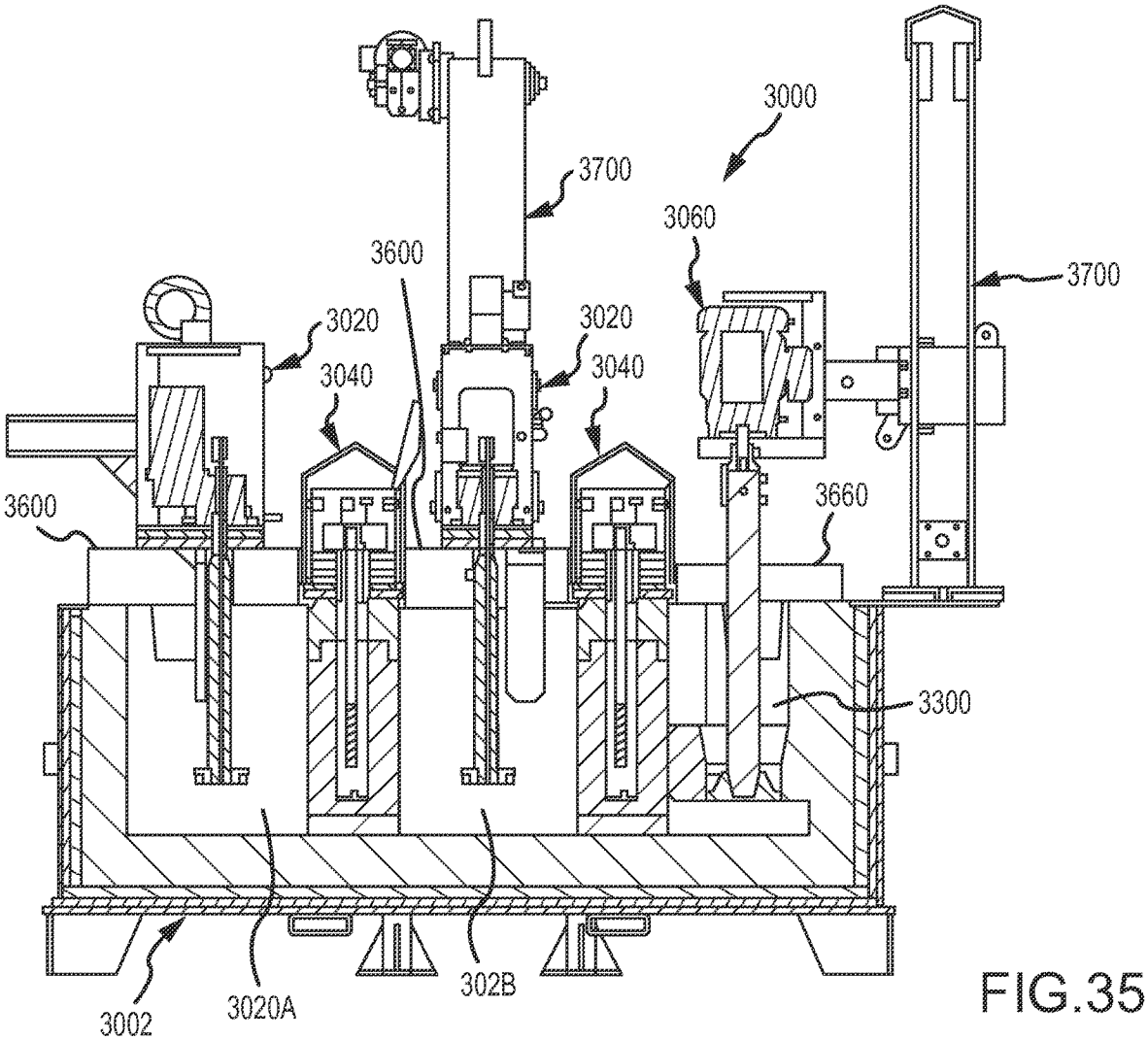
FIG. 35 is a cross-sectional, side view of the embodiment of FIG. 27 with the components in their operating position.

This embodiment also optionally includes fixed-position lifting structures 3700 that may be permanently fixed to the rotary degassers 3020 and pump 3010 to insert and remove them quickly from vessel 3002, and to rotate these components, without having to move the lifting structures, to a position where maintenance can be performed. This method is shown in FIGS. 32-34 and is a major advantage over existing methods of removal for maintenance, which usually require removing the components one at a time by a jib crane and then moving the components to a separate area for maintenance, or to remove each component using a forklift and again moving each to a separate area for maintenance.

Using the lifting devices of the present invention, which are fixed in place and rotate, the components can be lifted straight up with little chance of damaging them and simply rotated to a maintenance position.

After maintenance is completed, the components can be rotated back above vessel 3002 and lowered vertically down into vessel 3002 in the proper position, which again eliminates the chance of damage. So, this system and method saves time and reduces the likelihood of components being damaged.

System 3000 also includes access doors 3600, which help to keep heat from escaping vessel 3002 and that can be opened to access the interior cavity of 3002.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A system for transferring molten metal out of a vessel, the system comprising:

(a) a vessel, the vessel having an inlet, a cavity and including a transfer chamber having an opening at the bottom of the transfer chamber, the opening in communication with the cavity;

(b) the transfer chamber including an uptake section above the opening;

(c) an outlet in communication with the uptake section and that is positioned above the opening and leads out of the vessel; and (d) a molten metal pump having a motor, a drive shaft having a first end connected to the motor, the drive shaft extending into the uptake section that is above a rotor, the drive shaft having a second end connected to the rotor, wherein the rotor is in or beneath the uptake section and configured to move molten metal upward into the uptake section, where it exits the outlet and exits the vessel.

2. The system of claim 1 wherein the molten metal pump does not include a pump housing.

3. The system of claim 1 wherein the pump does not include support posts.

4. The system of claim 1 wherein the rotor comprises one or more rotor blades, and each blade includes:

(a) a first portion having (i) a leading edge with a thickness of ⅛" or greater, (ii) a first upper surface angled to direct molten metal upwards, and (iii) a first bottom surface with an angle equal to or less than the angle of the first upper surface as measured from a vertical axis; and (b) a second portion integrally formed with the first portion, the second portion having (i) a second upper surface angled to direct molten metal upwards, the angle of the second upper surface being greater than the angle of the first upper surface as measured from the vertical axis, and (ii) a second bottom surface, the second bottom surface having an angle greater than the angle of the first bottom surface as measured from the vertical axis.

5. The system of claim 1 wherein the rotor comprises one or more blades and each blade is vertically oriented and straight.

6. The system of claim 1 wherein the vessel is comprised of refractory material.

7. The system of claim 1 wherein the vessel has an inner bottom surface and the inner bottom surface is angled downwards towards the opening.

8. The system of claim 1 wherein the rotor has a diameter and is positioned in the transfer chamber and the portion of the transfer chamber in which the rotor is positioned in is circular and has a diameter of 1/32" or greater than the diameter of the rotor.

9. The system of claim 1 wherein the opening has a diameter of 1/32"-⅛" greater than the diameter of the rotor.

10. The system of claim 1 wherein the transfer chamber has a first section having a first cross-sectional area and a second section having a second cross-sectional area, the second section adjacent the opening and for receiving the rotor, and the second cross-sectional area being smaller than the first cross-sectional area.

11. The system of claim 10 that has a third section having a third cross-sectional area, the third section being between the first section and the second section, and the third cross-sectional area being smaller than the first cross-sectional area, but larger than the second cross-sectional area.

12. The system of claim 10 that further includes a superstructure for supporting the motor.

13. The system of claim 1 that includes one or more brackets for supporting the pump above the vessel.

14. The system of claim 13 wherein the vessel has a first side wall and a second side wall opposite the first side wall and the bracket comprises two metal beams that extend from the first side wall to the second side wall, and each bracket is connected to the first side wall, the second side wall and a superstructure of the pump.

15. The system of claim 1 that further includes a first tap-out opening in communication with the vessel cavity, the first tap-out opening being positioned lower than the rotor.

16. The system of claim 15 that includes a second tap-out opening on a side of the vessel opposite the side that includes the first tap-out opening.

17. The system of claim 16 that further includes a wall dividing the vessel into a first section that retains the transfer chamber and a second section that retains one or more degassers, the wall having an opening that keeps the first section and second section in fluid communication.

18. The system of claim 17 wherein there is a plurality of degassers.

19. The system of claim 18 that has three degassers.

20. The system of claim 18 wherein each at least two of the plurality of degassers are separated by a dividing wall wherein each dividing wall has one or more openings for allowing molten metal to pass through.

21. The system of claim 18 that includes at least one heating element between two of the plurality of degassers.

22. The system of claim 17 that includes a heating element between at least one degasser and the pump.

23. The system of claim 21 that includes a heating element between at least one degasser and the pump.

24. The system of claim 1 wherein the inlet and outlet are on the same side of the vessel.

25. The system of claim 1 wherein a launder extends from the outlet.

26. The system of claim 25 wherein the launder is between 6" and 6' in length.

27. The system of claim 25 wherein the launder is formed at a horizontal angle of one or more of the group selected from: 0°, an angle tilting backwards towards the outlet of between 1° and 3°, an angle tilting backwards towards the outlet of between 1° and 10°.

28. The system of claim 1 wherein there is a wall that separates the cavity from the transfer chamber and a channel is formed in the bottom of the wall and allows molten metal to pass from the cavity to the opening.

29. The system of claim 1 wherein the vessel has an upper perimeter, and the transfer chamber has an upper perimeter, and a platform of the molten metal pump is supported by at least the upper perimeter of the transfer chamber in order to support the pump.

30. The system of claim 29 wherein the platform of the molten metal pump also rests on at least the upper perimeter of the vessel.

31. The system of claim 29 wherein the transfer chamber includes a first wall having a first outer surface and a second wall having a second outer surface, and one side of the platform includes a first centering bracket and the opposite side of the platform includes a second centering bracket; the first centering bracket being juxtaposed the first outer surface and the second centering bracket being juxtaposed the second outer surface to help center the shaft and rotor in the transfer conduit.

32. The system of claim 1 wherein the rotor has a plurality of blades.

33. The system of claim 32 wherein each blade is has a flat surface that pushes molten metal outward.

34. The system of claim 32 wherein each blade is dual-flow, with a first, angled portion that moves molten metal upward and a second portion that moves molten metal outward, the second portion positioned above the first, angled portion.

35. The system of claim 1 wherein the vessel includes a top and one or more access doors covering at least part of the top in order to keep heat in.

36. The system of claim 1 wherein the pump does not include a superstructure.

37. The system of claim 2 wherein the pump does not include a superstructure.

38. The system of claim 2 wherein the pump does not include support posts.

39. The system of claim 36 wherein the pump does not include support posts.

40. The system of claim 39 that further includes one or more rotary degassers.

41. The system of claim 40 wherein each of the one or more rotary degassers is between the inlet and the transfer chamber.

* * * * *